US008727398B2

(12) United States Patent
Brose et al.

(10) Patent No.: US 8,727,398 B2
(45) Date of Patent: May 20, 2014

(54) MOTOR VEHICLE LOCK

(75) Inventors: Simon Brose, Hattingen (DE); Roman Joschko, Dormagen (DE); David Rosales, Wuppertal (DE); Stefanic Josip, Odenthal (DE); Abdelali El Hamoumi, Remscheid (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 1065 days.

(21) Appl. No.: 12/679,201

(22) PCT Filed: Sep. 21, 2008

(86) PCT No.: PCT/EP2008/007960

§ 371 (c)(1),
(2), (4) Date: Nov. 23, 2010

(87) PCT Pub. No.: WO2009/040074

PCT Pub. Date: Apr. 2, 2009

(65) Prior Publication Data

US 2011/0084505 A1 Apr. 14, 2011

(30) Foreign Application Priority Data

Sep. 21, 2007 (DE) ..... 20 2007 013 330 U
Nov. 13, 2007 (DE) ..... 10 2007 054 440
Apr. 10, 2008 (DE) ..... 10 2008 018 500

(51) Int. Cl.
*E05C 3/06* (2006.01)

(52) U.S. Cl.
USPC ..... 292/198; 292/84; 292/195

(58) Field of Classification Search
USPC ..... 292/198, 195, 209, 84 X
See application file for complete search history.

(56) References Cited

U.S. PATENT DOCUMENTS 1,769,489 A * 7/1930 Carrier ..... 292/195
3,584,907 A * 6/1971 Mertes ..... 292/336
4,441,345 A * 4/1984 Guarr ..... 70/240
4,455,042 A * 6/1984 Yamada ..... 292/201

(Continued)

FOREIGN PATENT DOCUMENTS

DE 10350325 5/2004
DE 10258645 7/2004

(Continued)

OTHER PUBLICATIONS

Recherchebericht (German Search Report), search completed Apr. 29, 2008, German Patent 202007013330.8, 4 pages.

(Continued)

*Primary Examiner* — Mark Williams
(74) *Attorney, Agent, or Firm* — Pauly, Devries Smith & Deffner, L.L.C.

(57) ABSTRACT

The present invention relates to a motor vehicle lock having the locking elements of a lock catch and a pawl and having a lock mechanism, with it being possible for the lock mechanism to be moved into different functional states such as "unlocked", "locked", "anti-theft locked" or "child-safety locked" and with the lock mechanism having for this purpose at least one functional element which can be adjusted into corresponding functional positions. It is proposed that at least one functional element is designed as a resiliently elastically bendable wire or strip, and can thereby be bent in a resiliently elastic manner, as a bendable functional element, into different functional positions.

20 Claims, 16 Drawing Sheets

(56) References Cited

U.S. PATENT DOCUMENTS

| | | | | |
|---|---|---|---|---|
| 4,601,500 | A | 7/1986 | Bernard | |
| 4,906,035 | A * | 3/1990 | Nagai et al. | 292/201 |
| 4,941,694 | A | 7/1990 | Bartel et al. | |
| 5,549,337 | A | 8/1996 | McCulloch | |
| 5,618,070 | A * | 4/1997 | Tunis et al. | 292/228 |
| 6,519,986 | B2 | 2/2003 | Wicker | |
| 7,568,740 | B2 | 8/2009 | Brose et al. | |
| 2002/0063430 | A1 | 5/2002 | Amano | |
| 2003/0094818 | A1 * | 5/2003 | Tomaszewski et al. | 292/195 |
| 2005/0006908 | A1 | 1/2005 | Bruwer et al. | |
| 2006/0103145 | A1 | 5/2006 | Ottolini et al. | |
| 2006/0267351 | A1 * | 11/2006 | Spurr | 292/216 |
| 2011/0108052 | A1 * | 5/2011 | Morgandi et al. | 132/230 |
| 2011/0181052 | A1 * | 7/2011 | Brose et al. | 292/92 |
| 2011/0210564 | A1 * | 9/2011 | Sun et al. | 292/144 |
| 2011/0252844 | A1 * | 10/2011 | Shoemaker | 70/100 |
| 2012/0068480 | A1 * | 3/2012 | Bendel et al. | 292/220 |

FOREIGN PATENT DOCUMENTS

| | | |
|---|---|---|
| DE | 102004017014 | 10/2005 |
| DE | 102004042444 | 3/2006 |
| EP | 1845224 | 10/2007 |
| JP | 2027079 | 2/1996 |
| JP | 2027080 | 2/1996 |
| WO | WO-98/28508 | 7/1998 |

OTHER PUBLICATIONS

International Search Report for PCT/EP2008/007960, mailed Feb. 6, 2009, 6 pages.

* cited by examiner

MOTOR VEHICLE LOCK

CROSS-REFERENCE TO RELATED APPLICATIONS

This application is a national stage application under 35 U.S.C. 371 of International Patent Application Serial No. PCT/EP2008/007960, entitled "MOTOR VEHICLE LOCK," filed Sep. 21, 2008, which claims priority from German Patent Application No. 20 2007 013 330.8, filed Sep. 21, 2007; German Patent Application No. 10 2007 054 440.7, filed Nov. 13, 2007; and German Patent Application No. 10 2008 018 500.0, filed Apr. 10, 2008. The entire content of each of these applications is incorporated herein by reference.

FIELD OF THE INVENTION

The invention relates to a motor vehicle lock and to a control drive for a motor vehicle lock of said type.

The motor vehicle lock in question is used in all types of closure elements of a vehicle. These include in particular side doors, rear doors, tailgates, trunk lids or engine hoods. Said closure elements may fundamentally also be designed in the form of sliding doors.

BACKGROUND OF THE INVENTION

The known motor vehicle lock (DE 102 58 645 B4), on which the invention is based, has a motor vehicle lock with the locking elements of a lock catch and a pawl. In the usual way, the pawl can be moved into an open position, into a main locked position and into a pre-locked position. Here, the pawl performs the task of holding the lock catch in the two locked positions. To release the lock catch, the pawl must be manually raised.

In the known motor vehicle lock, the manual raising of the pawl is provided within the context of the realization of a mechanical redundancy. This means that the pawl is normally raised by means of a motor, and is manually raised only in an emergency situation, for example in the event of a power failure.

The known motor vehicle lock is also equipped with a lock mechanism which can be switched into different functional states. These are the functional states "unlocked", "locked", "anti-theft locked" and "child-safety locked". In the "unlocked" functional state, the associated motor vehicle door can be opened by actuating the door inner handle and the door outer handle. In the "locked" functional state, opening cannot be carried out from the outside but can be carried out from the inside. In the functional state "anti-theft locked", opening can be carried out neither from the outside nor from the inside. In the "child-safety locked" state, opening can be carried out from the outside, but not from the inside.

It is now conventionally the case that the door outer handle is coupled to an outer actuating lever and the door inner handle is coupled to an inner actuating lever, with the two actuating levers being coupled to or decoupled from the pawl depending on the functional state. For this purpose, the lock mechanism is equipped with a coupling arrangement in which a coupling peg interacts with different control slots. Such a realization of the above coupling function is mechanically cumbersome since the adjustability of the coupling peg is always associated with the use of corresponding bearing and guide elements.

SUMMARY OF THE INVENTION

The invention is based on the problem of developing and refining the known motor vehicle lock in such a way as to simplify the structural design.

The above problem is solved, in the case of a motor vehicle lock having the features of the preamble of claim 1, by means of the features of the characterizing part of claim 1. What is essential is the consideration that the definitive functional element for realizing the different functional states of the lock mechanism can be designed in the form of a resiliently elastically bendable wire or strip. Such a functional element is referred to hereinafter as a bendable functional element. The expression "wire" relates here in particular to the shape, not to the material of the element.

Here, the adjustment of the bendable functional element into the different functional positions is attributed entirely to a corresponding bending of the bendable functional element. It is thus possible to dispense with a bearing or guide element.

In the preferred development, the bendable functional element provides a switchable coupling between two adjusting elements of the motor vehicle lock. The coupling function is realized in a simple manner in that the bendable functional element is adjusted by being correspondingly bent into the movement range of the adjusting elements to be coupled, in such a way that one adjusting element can follow the movement of the other adjusting element. As a result of its resilient elasticity, it is likewise possible for the bendable functional element to follow said movement. Said realization of a coupling with a bendable functional element can be implemented with minimal structural expenditure.

The subject matter of claim 18 relates to a particularly simple realization of the adjustment of the bendable functional element. Here, a control drive with a control shaft is provided, on which control shaft the associated bendable functional element is supported. This can be realized in a structurally simple manner. One particular advantage is also that the control shaft may have a plurality of control sections which are arranged adjacent to one another and which are assigned to different bendable functional elements.

In the preferred development, it is provided that the lock mechanism can, in parallel, be moved into the "child-safety locked" position. The setting of the "child-safety locked" position takes place in parallel to the setting of the other functional states, since for example a locking and unlocking can take place regardless of the engaged child-safety locking arrangement, that is to say parallel to the engagement of the child-safety locking arrangement. This is realized in that, when the child-safety locking arrangement is engaged, the "unlocked" functional position automatically passes into the "unlocked—child-safety locked" functional position. When the child-safety locking arrangement is engaged, therefore, an unlocking process causes an adjustment of the bendable functional element no longer into the "unlocked" functional position but rather into the "unlocked—child-safety locked" functional position.

A further teaching, which is worthy of protection in itself, claims the abovementioned control drive for a motor vehicle lock. All statements relating to the motor vehicle lock according to the proposal which are suitable for describing the control drive apply in their entirety to said further teaching.

BRIEF DESCRIPTION OF THE DRAWINGS

Further details, features, aims and advantages of the present invention are explained in more detail below on the basis of preferred exemplary embodiments. In the drawing.

DETAILED DESCRIPTION OF THE DRAWINGS

Figure 1:
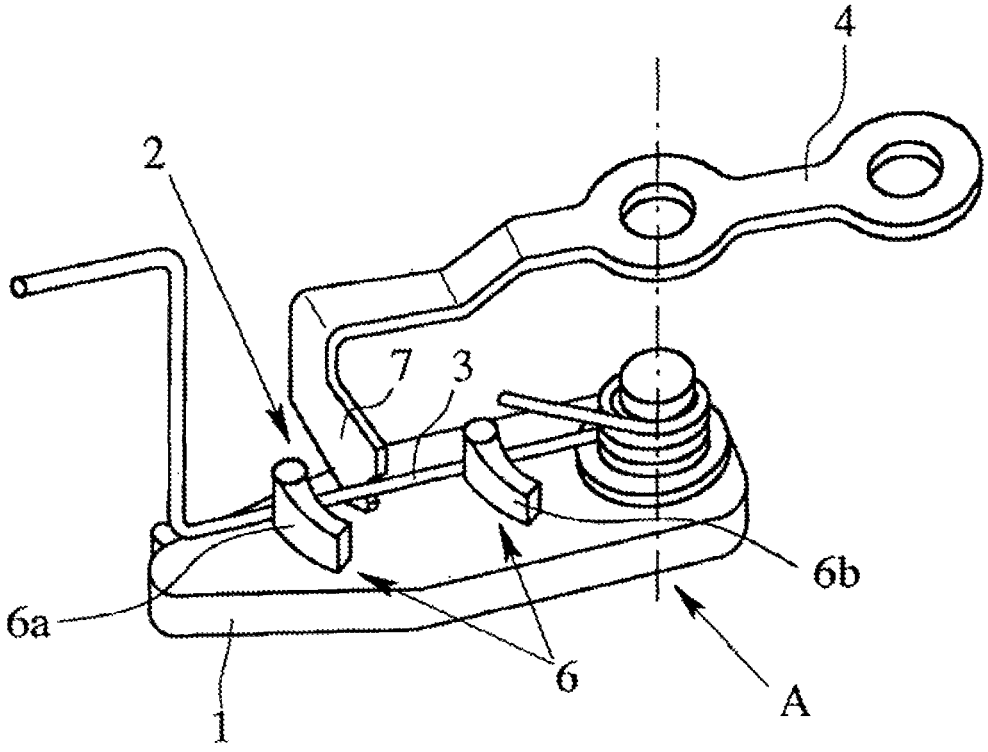
FIG. 1 shows a motor vehicle lock according to the proposal with the components essential to the explanation of the invention, in a perspective illustration.

It can be pointed out firstly that the drawing illustrates only those components of the motor vehicle lock according to the proposal or of the control drive according to the proposal which are necessary for explaining the teaching. Correspondingly, a lock catch which interacts in the usual way with the pawl is not illustrated in FIGS. 1 to 9 and 13, 14.

FIGS. 1 to 3 and 4, 5 show two embodiments of a motor vehicle lock according to the proposal, which has the locking elements of a lock catch and a pawl 1. Also provided is a lock mechanism 2 which can be moved into different functional states such as "unlocked", "locked", "anti-theft locked" or "child-safety locked". In general, the lock mechanism 2 ensures that, depending on the functional state, the pawl 1 can be raised by means of an actuation of the door outer handle and/or of the door inner handle or not at all. In the case of an electric lock, the lock mechanism 2 may also serve merely to couple an emergency actuation to the pawl 1. The expression "lock mechanism" should thus be understood in a broad sense.

To adjust the lock mechanism 2 into the above functional states, it has at least one functional element 3 which can be adjusted into corresponding functional positions. The lock mechanism 2 can thus be moved into the desired functional states by means of an adjustment of the functional element 3 or of the functional elements.

To realize the functional states of the lock mechanism 2, it is fundamentally possible for a plurality of functional elements 3 to be provided. Hereinafter, however, only a single functional element 3 in the above sense is provided, but this should not be understood to be restrictive.

Figure 2:
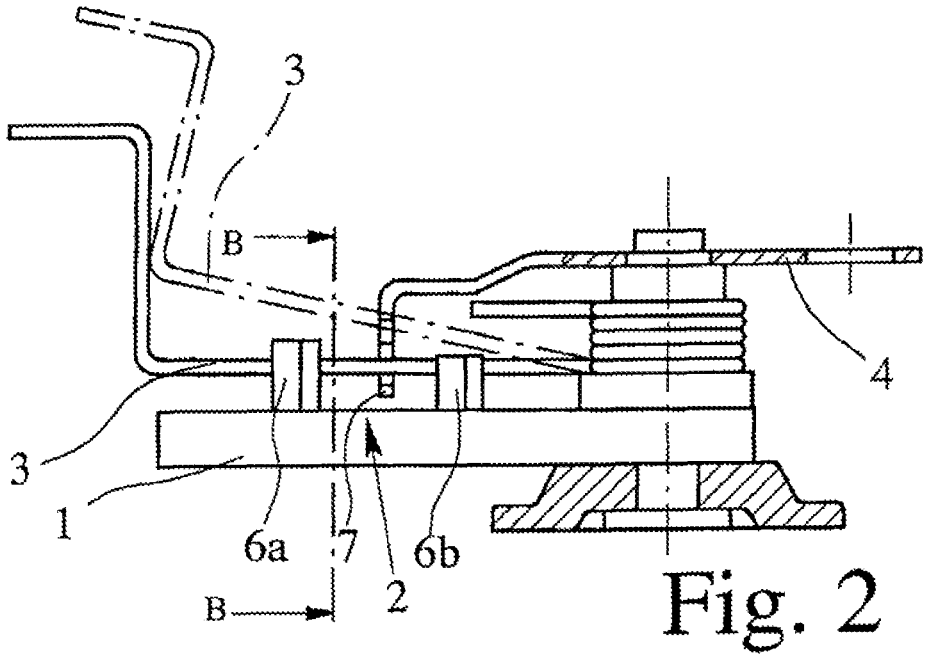
FIG. 2 shows the motor vehicle lock according to FIG. 1 in the view A.

It is now essential that the functional element 3 illustrated in the illustrated exemplary embodiments is designed in the form of a resiliently elastically bendable wire, and can thereby be bent in a resiliently elastic manner, as a bendable functional element 3, into the different functional positions. FIG. 2 shows two functional positions, which are to be explained below. A juxtaposition of FIGS. 1 and 2 shows that the adjustment of the bendable functional element 3 is attributed to a resiliently elastic bending of the latter. The effect and the triggering of said adjustment is explained in detail further below.

If a plurality of functional elements 3 is provided, at least one of the functional elements 3 is designed as a bendable functional element 3. Other functional elements 3 may be designed in the usual way with slidable coupling pegs or the like.

It can be seen from the illustration of FIG. 2 that the bendable functional element 3 is bendable substantially about a geometric bending axis which is aligned perpendicular to the longitudinal extent of at least a part of the bendable functional element 3.

With regard to the material selection for the bendable functional element 3, various preferred alternatives are conceivable. In one particularly preferred development, the bendable functional element 3 is composed of a metal material, preferably spring steel. It may however also be advantageous for the bendable functional element 3 to be formed from a plastic material.

For the shaping of the bendable functional element 3, too, various advantageous alternatives are conceivable. The bendable functional element 3 preferably has a circular cross section. From a production aspect in particular, it may however also be advantageous for the bendable functional element 3 to be of strip-shaped design, since such elements can be fastened in a simple manner.

In the illustrated and thus preferable exemplary embodiments, the bendable functional element 3 is of straight design in sections. Depending on the application, it may however also be advantageous for the bendable functional element 3 to be adapted to the structural conditions and to differ considerably from a straight design.

In the illustrated and thus preferable exemplary embodiments, the bendable functional element 3 is formed as a single piece of wire which has the same resiliently elastic properties over its entire length. It may however also be advantageous for the bendable functional element 3 to be resiliently elastically flexible only in sections and to otherwise be of more rigid design. This may be achieved for example by means of a wire cross section which varies over the length of the wire.

One simple realization of the bendable functional element 3 can be implemented by virtue of the bendable functional element 3 being designed in the form of a flexible beam. The expression "flexible beam" is to be understood broadly here.

This means that the bendable functional element 3 is fixed at a point from which the adjustable part of the bendable functional element 3 extends. According to this understanding, the bendable functional element 3 illustrated in the drawing is also designed in the form of a flexible beam.

The bendable functional element 3 may fundamentally serve as an actuating element, for example for a coupling. In the illustrated and thus preferable exemplary embodiments, however, the bendable functional element 3 itself provides a switchable coupling between pivotable adjusting elements 1, 4, 5 of the motor vehicle lock. This is explained in more detail further below on the basis of the physical functional positions of the lock mechanism 2.

What is essential firstly is very generally that the bendable functional element 3, in a first functional position, is or can be engaged with the adjusting elements 1, 4, 5 and couples the adjusting elements 1, 4, 5, and in a second functional position, is disengaged from at least one adjusting element 1, 4, 5 and decouples the adjusting elements 1, 4, 5. Here, and preferably, the adjusting elements 4, 5—still to be explained below—are coupled to the adjusting element 1—the pawl 1. Here, substantially any desired combinations are conceivable.

In a preferred development, it is provided that the lock mechanism 2 can, by means of an adjustment of the bendable functional element 3 into different functional positions, be moved into the corresponding functional states "unlocked" and "locked". In a particularly preferable development, it is also possible by means of a corresponding adjustment of the bendable functional element 3 to attain the "anti-theft locked" functional state and possibly the "child-safety locked" functional state. For this purpose, it is fundamentally also possible for a plurality of bendable functional elements 3 to be provided.

It can be seen from the drawing that the force which can be transmitted via the bendable functional element 3 acts perpendicular to the extent of the bendable functional element 3. In this way, the engagement between the adjusting elements 1, 4, 5 and the bendable functional element 3 can be realized in a simple manner, as shown further below.

It is fundamentally possible for the bendable functional element 3, in one functional position, to also exert a blocking action on an adjusting element of the lock mechanism 2. It is then preferable for the blocking force to act perpendicular to the extent of the bendable functional element 3.

Figure 3:
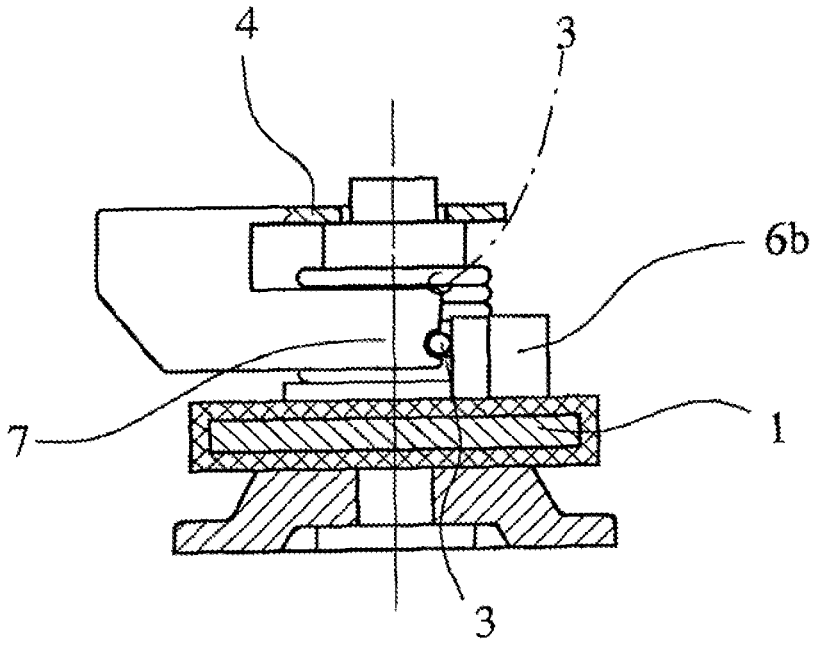
FIG. 3 shows the motor vehicle lock according to FIG. 2 in a sectional view along the section line B-B.

The abovementioned adjusting elements 1, 4, 5 are firstly the pawl 1 and secondly the outer actuating lever 4 and the inner actuating lever 5 of the lock mechanism 2. FIGS. 1 to 3 show a preferred variant without the inner actuating lever 5, which may be advantageous in certain applications.

Here, and preferably, the lock mechanism 2 can, by means of an adjustment of the at least one bendable functional element 3 into different functional positions, be moved into the corresponding functional states "unlocked" and "locked", preferably into the functional state "anti-theft locked" and in particular into the functional state "child-safety locked" (not illustrated).

In one particularly preferred development, it is provided for this purpose that the bendable functional element 3 is aligned substantially radially in relation to the pivot axis of the pawl 1. This means that the bendable functional element 3 correspondingly extends radially. In the illustrated and thus preferable exemplary embodiments, the bendable functional element 3 also extends substantially along the pawl 1. Said radial alignment may also fundamentally be in relation to one of the pivot axes of the outer actuating lever 4 or of the inner actuating lever 5 which may be provided. Here, however, this makes no difference since the pawl 1, the outer actuating lever 4 and the inner actuating lever 5 are pivotable on the same pivot axis. With such an arrangement, it is possible to attain a good degree of compactness. In this context, the pivot axis may be the physical pivot axis or else merely the geometric pivot axis.

The bendable functional element 3 is preferably fixed at one end in particular to the lock housing. In the illustrated exemplary embodiments, the bearing bolt which is fixed with respect to the housing and which is assigned to the pawl 1 serves for this purpose. It is however also conceivable for the bendable functional element 3 to be fixed to the pawl 1 itself.

To realize the abovementioned coupling between the outer actuating lever 4 and the pawl 1, it is preferably provided that the pawl 1 or a lever which is coupled to the pawl 1 has a pawl driver contour 6, with it also being preferable for the outer actuating lever 4 or a lever which is coupled to the outer actuating lever 4 to have an outer actuating driver contour 7. Here, in the illustrated exemplary embodiments, the arrangement is designed such that, when the bendable functional element is in the "unlocked" functional position, the outer actuating lever 4 is coupled by means of the outer actuating lever driver contour 7, the bendable functional element 3 and the pawl driver contour 6 to the pawl 1. Said functional position can be seen most clearly in FIGS. 1 to 4.

It is also preferably provided that, in the "locked" functional state, the bendable functional element 3 is disengaged from the pawl driver contour 6 and from the outer actuating driver contour 7, such that the outer actuating lever 4 is decoupled from the pawl 1. The "unlocked" functional position is illustrated in FIG. 2 by means of dashed lines.

To realize the "unlocked" functional position, it would be sufficient for the bendable functional element 3 to be disengaged from one of the two above driver contours 6, 7.

It can be seen from the illustration in FIG. 1 that a pivoting movement of the outer actuating lever 4 to the left as viewed from above causes the outer actuating driver contour 7 to engage with the bendable functional element 3 and to exert a force on the bendable functional element 3, perpendicular to the direction of extent of the bendable functional element 3, at the engagement point. This leads to the bendable functional element 3 acting on the pawl driver contour 6, such that the pawl 1 is adjusted, in this case raised.

There are numerous conceivable advantageous options for the design of the driver contours 6, 7. Here, and preferably, the pawl driver contour 6 is composed of two bearing blocks 6*a*, 6*b*, between which the outer actuating driver contour 7 runs through in the "locked" functional position. This has the advantage that the bendable functional element 3 is supported optimally at the engagement point at which the actuating force is transmitted.

Another preferred variant provides that the pawl driver contour 6 has merely a slot into which the outer actuating driver contour 7 runs in the "locked" functional position. In the "unlocked" functional position, the slot is blocked by the bendable functional element 3.

It is pointed out that the two driver contours 6, 7 are directly interchangeable. This means that the described bearing blocks 6*a*, 6*b* or the described slot may also be arranged on the outer actuating lever 4.

Figure 4:
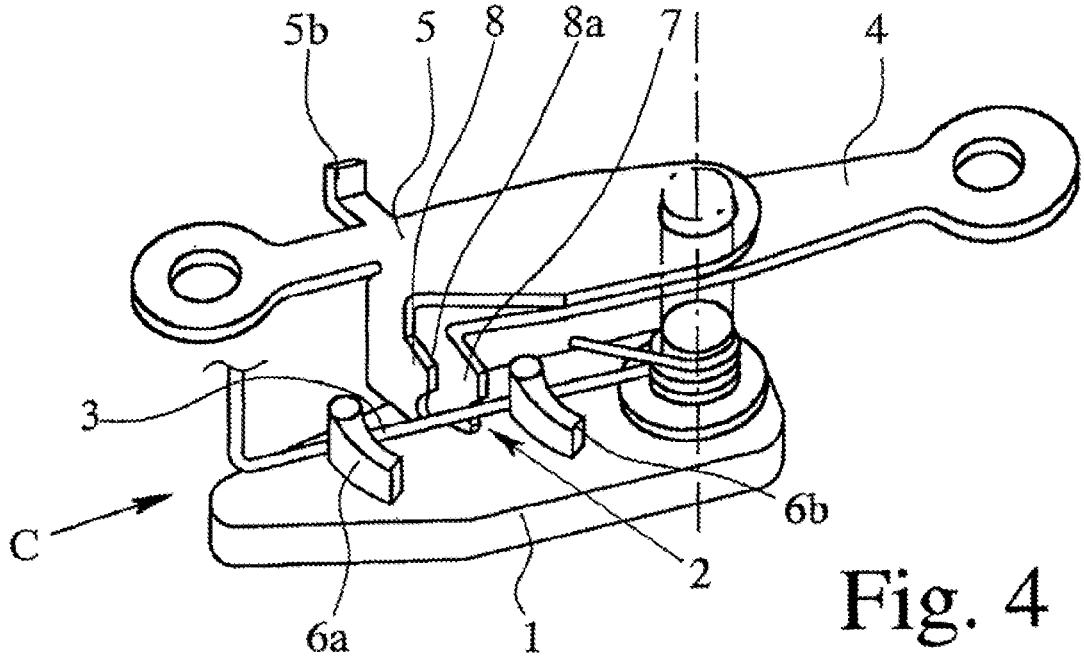
FIG. 4 shows a further motor vehicle lock according to the proposal in a view as per FIG. 1.
Figure 5:
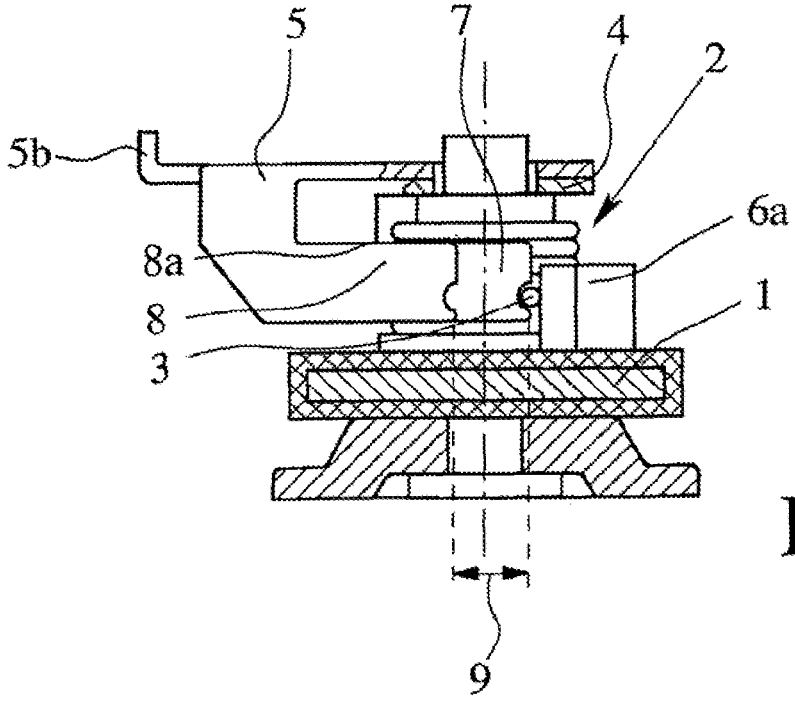
FIG. 5 shows the motor vehicle lock according to FIG. 4 in a view as per FIG. 3.

In the further preferred development according to FIGS. 4 and 5, an inner actuating lever 5 is provided in addition to the outer actuating lever 4. Correspondingly, it is additionally preferably provided that the inner actuating lever 5 or a lever which is coupled to the inner actuating lever 5 has an inner actuating driver contour 8. Here, when the bendable functional element 3 is in the "unlocked" functional position, the inner actuating lever 5 is coupled by means of the inner actuating driver contour 8, the bendable functional element 3 and the pawl driver contour 6 to the pawl 1. The pawl 1 can thus also be raised by means of the inner actuating lever 5. Furthermore, it is correspondingly provided here that, in the "locked" functional state, the bendable functional element 3 is disengaged from the pawl driver contour 6 and from the inner actuating driver contour 8, and the inner actuating lever 5 is thereby decoupled from the pawl 1. Here, too, it may be provided that the bendable functional element 3 is disengaged only from one of the two driver contours 6, 8.

Since, in the "locked" functional position, an actuation of the inner actuating lever 5 must nevertheless lead to a raising of the pawl 1, it is provided here, and preferably, that an actuating of the inner actuating lever 5 causes the lock mechanism 2 to be moved from the "locked" functional state into the "unlocked" functional state. The details of how said unlocking process takes place will be explained further below.

It is essential here initially that, with regard to the actuation of the inner actuating lever 5, an initial free travel is provided and that the unlocking process takes place when said free travel is run through. The free travel is preferably realized such that, in the non-actuated state, the inner actuating driver contour 8 is spaced apart from the bendable functional element 3 by a free travel spacing 9.

In the preferred embodiment with free travel, in the "locked" functional position, a pivoting movement of the inner actuating lever 5 firstly causes the unlocking (in any desired manner, not illustrated in FIGS. 1 to 5), as a result of which the bendable functional element 3 falls from the deflected position into the position illustrated in FIG. 4. As the inner actuating lever 5 pivots further, the pawl 1 is then raised.

It may however fundamentally also be provided that, in the "locked" functional position, a twofold pivoting of the inner actuating lever 5 is required. This is generally referred to as a "double-lift taxi function". This variant is also easy to realize. During the first pivoting of the inner actuating lever 5, the bendable functional element 3 could specifically fall onto the shoulder 8*a*, which can be seen in FIGS. 4, 5, of the inner actuating driver contour 8. The bendable functional element 3 would however remain held there only until the inner actuating lever 5 pivots back, in order to then be pivoted for a second time, this time so as to raise the pawl 1.

There are numerous conceivable options for the fastening of the bendable functional element 3. For example, the bendable functional element 3 may be fastened to the lock housing or to the participating adjusting elements 1, 4, 5. It is also conceivable for the bendable functional element 3 to be extrusion-coated onto the lock housing or onto one of the participating adjusting elements 1, 4, 5 if the bendable functional element 3 is produced from a plastic material in an injection-molding process. The bendable functional element 3 may however also be a part of an already-existing pawl spring, outer actuating lever spring or inner actuating lever spring (see for example FIGS. 1 to 3). This will be explained further below.

For the controlled adjustment, that is to say for the controlled resiliently elastic bending of the bendable functional element 3, a control drive 10 is provided. It is fundamentally also possible for a plurality of bendable functional elements 3 for adjustment, or other functional elements 3 of conventional design, to be associated with the control drive 10. By means of the control drive 10, the associated bendable functional element 3 can be adjusted correspondingly into some functional positions. Some functional positions are attained by means of the resiliently elastic return of the bendable functional element 3. Two preferred exemplary embodiments for a control drive 10 according to the proposal are shown in highly schematic form in FIGS. 6, 7 and FIGS. 8, 9.

In the illustrated and thus preferable exemplary embodiments, the control drive 10 has a control shaft 11 on which the associated bendable functional element 3 is supported, such that the bendable functional element 3 can be deflected by means of an adjustment of the control shaft 11. In a particularly preferred development, the bendable functional element 3, at least at the support point, extends substantially perpendicular to the control shaft axis 12.

The control drive 10 is preferably a control drive 10 in the form of a motor. The control shaft 11 is then—as illustrated—coupled to a drive motor 13. Here, the control shaft 11 may be arranged directly on the motor shaft 14 of the drive motor 13. It is however also conceivable for the control shaft 11 to be in driving engagement with the motor shaft 14 via a pinion or the like.

The control drive 10 may also be designed to be manually adjustable. For example, the control drive 10 is then connected to corresponding manual actuating elements such as a lock cylinder or an inner locking button.

The control shaft 11 may be moved—by motor drive or manually—into the "unlocked" and "locked" control positions. Here, said control shaft 11 respectively moves the bendable functional element 3 into the "locked" functional position or allows said bendable functional element 3 to return into the "unlocked" functional position.

Here, and preferably, the control shaft 11 is designed in the form of a camshaft, wherein the associated bendable functional element 3 is supported on the camshaft and can be correspondingly deflected by means of an adjustment of the camshaft. This is illustrated in FIG. 7.

Figure 6:
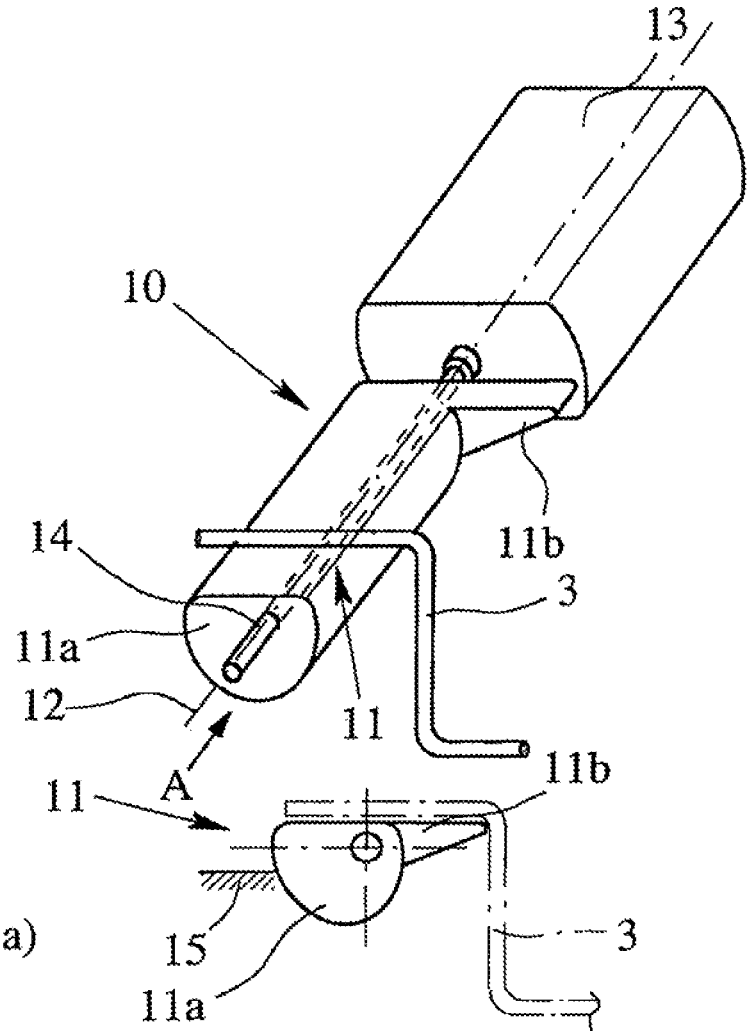
FIG. 6 shows a control drive according to the proposal in a perspective view.
Figure 7:
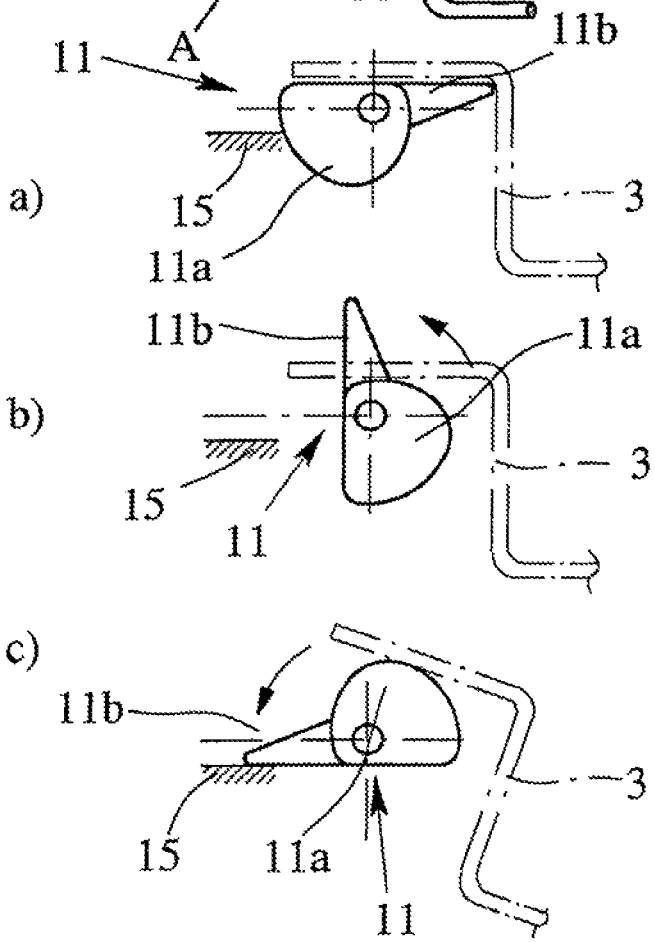
FIG. 7 shows the control drive according to FIG. 6 in the view A in three control positions.

Here, FIG. 7*a*) shows the "unlocked" functional position, which corresponds to the illustrations in FIGS. 1, 4. FIG. 7*b* shows a first adjustment of the control shaft 11, rotated to the left in FIG. 7, without the bendable functional element 3 being adjusted. In this way, the drive motor 13 is subjected to only low loading during starting, which leads to a cost-effective design of the drive motor. During a further adjustment of the control shaft 11, the cam 11*a* which is arranged on the control shaft 11 deflects the bendable functional element 3 in FIG. 7 upward (FIG. 7*c*)). This corresponds to the "locked" functional position. Said functional position of the bendable functional element 3 is illustrated by dashed lines in FIG. 2. It can be seen from a juxtaposition of FIGS. 6 and 7 that the adjustment of the bendable functional element 3 can be realized in a particularly simple manner in terms of design by means of a control shaft 11.

One preferred alternative to the design of the control shaft 11 in the form of a camshaft is for the control shaft 11 to be designed in the form of a crankshaft. The associated bendable functional element 3 is then correspondingly supported on the crankshaft, in particular on the eccentric sections of the crankshaft. It is particularly advantageous in production terms for the control shaft 11 to be designed in the form of a bent wire. A particularly compact arrangement is provided if the control shaft 11 is simultaneously the motor shaft 14 of the drive motor 13.

It has already been discussed further above that, in the "locked" functional state, the actuation of the inner actuating lever 5 leads to an unlocking process. In the exemplary embodiments illustrated in FIGS. 6, 7 and 8, 9, which are thus preferred, the control shaft 11 is for this purpose provided with an override contour 11*b*. Associated with said override contour 11*b* is a further override contour 5*b* which is arranged on the inner actuating lever 5 or on a lever which is coupled to the inner actuating lever, which further override contour 5*b* is illustrated in FIGS. 4 and 5.

In the "locked" functional state (FIG. 7*c*), in the event of an actuation of the inner actuating lever 5, the inner-actuating-lever-side override contour 5*b* engages with the control-shaft-side override contour 11*b* and moves the control shaft 11 into the "unlocked" position (FIG. 7*a*)). In this way, the bendable functional element 3 is correspondingly moved into the "unlocked" functional position and, as a result, the lock mechanism 2 is moved into the "unlocked" functional state. Other variants are conceivable for the configuration of said unlocking process.

The positioning of the control shaft 11 takes place preferably in the blocked mode. In the exemplary embodiment illustrated in FIGS. 6, 7, during the adjustment of the control shaft 11 from the "unlocked" control position into the "locked" control position, the override contour 11*b* abuts against a blocking element 15. The return of the control shaft 11 into the "unlocked" control position may likewise take place in the blocked mode. A control engineering solution is however also conceivable for this purpose. Here, and preferably, a further blocking element is not provided.

Figure 8:
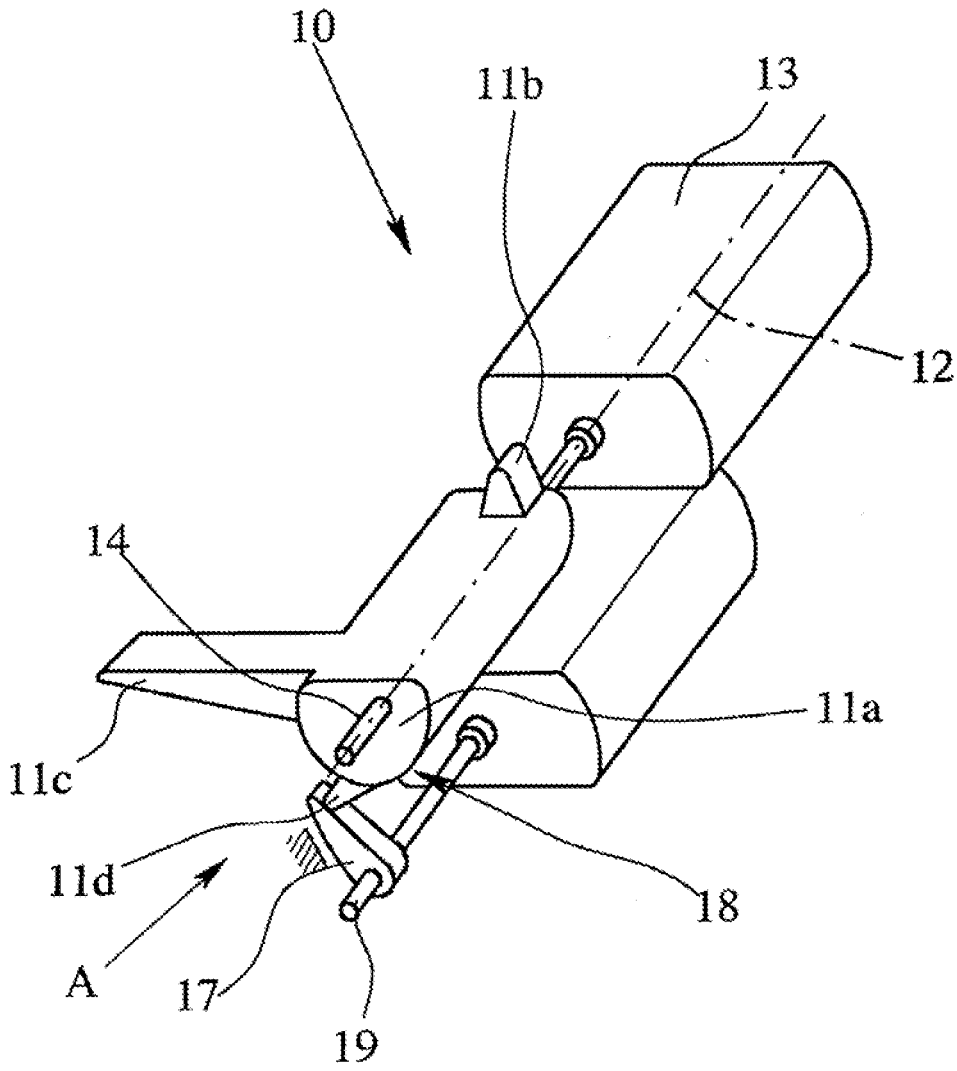
FIG. 8 shows a further control drive according to the proposal in a view as per FIG. 6
Figure 9:
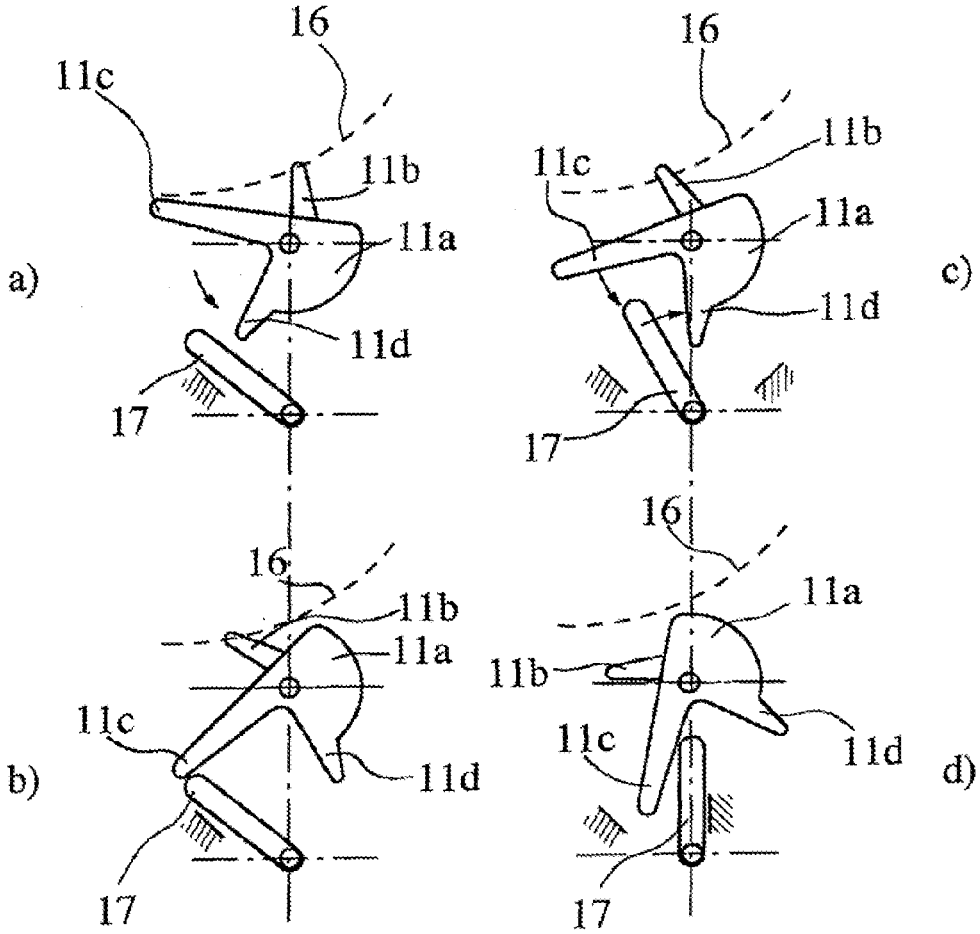
FIG. 9 shows the control drive according to FIG. 8 in the view A in four control positions.

The exemplary embodiment illustrated in FIGS. 8, 9 corresponds to the exemplary embodiment illustrated in FIGS. 6, 7, which has been expanded to realize the functional state of "anti-theft locked". Correspondingly, the control shaft 11 can be moved into the "anti-theft locked" control position, which initially corresponds, with regard to the adjustment of the bendable functional element 3, to the "locked" control position. However, in the "anti-theft locked" control position, the control shaft 11 is positioned such that the control-shaft-side override contour 11*b* is situated outside the range of movement 16 of the inner-actuating-side override contour 5*b*.

FIG. 9 shows the different control positions of said preferred exemplary embodiment. FIG. 9*a*) shows the unlocked state, in which, as already explained, the bendable functional element 3 is not deflected. In contrast, FIG. 9*b*) shows the "locked" control position, in which the bendable functional element 3 is deflected and the control-shaft-side override contour 11*b* is situated in the range of movement 16 of the inner-actuating-side override contour 5*b*. FIG. 9*c* shows an intermediate state between the "unlocked" control position and the "anti-theft locked" control position. FIG. 9*d*) shows the "anti-theft locked" control position. A juxtaposition of FIGS. 9*b*) and 9*d*) shows that, here, and preferably, the deflection of the bendable functional element 3 into the "locked" and "anti-theft locked" control positions is identical.

What is essential in the "anti-theft locked" control position illustrated in FIG. 9*d*) is the fact that the control-shaft-side override contour 11*b* is situated outside the range of movement 16 of the inner-actuating-side override contour 5*b*. It is thereby ensured that, in the "anti-theft locked" functional state, the pawl 1 also cannot be raised by the inner actuating lever 5.

In the exemplary embodiment illustrated in FIGS. 8, 9, too, the control shaft 11 is controlled at least in part in the blocked mode. This relates at any rate to the "locked" and "anti-theft locked" control positions (FIG. 9*b*), 9*d*)). For this purpose, the control shaft 11 has a blocking contour 11*c* which can be engaged with a blocking element 17. Here, and preferably, the blocking element 17 is of adjustable design and can be moved into the "locked" blocking position (FIG. 9*b*)) and "anti-theft locked" blocking position (FIG. 9*d*)). A further drive motor 18 is provided for the adjustment of the blocking element 17. A manual adjustment of the blocking element 17 is however fundamentally possible here too. The blocking element 17 may be arranged directly on the motor shaft 19 of the drive motor 18. It is however fundamentally also conceivable for the blocking element 17 to be drive-coupled to the drive motor 18 via a pinion or the like.

Different blocking positions of the control shaft 11 can be realized by means of an adjustment of the blocking element 17. When the blocking element 17 is situated in the "locked" blocking position, the control shaft 11 is blocked in the "locked" control position (FIG. 9*b*)). When the blocking element 17 is situated in the "anti-theft locked" blocking position, the control shaft 11 is blocked in the "anti-theft locked" control position (FIG. 9*d*)). Ultimately, the blocking element 17 performs the function of an anti-theft locking lever, while the drive motor 18 performs the function of an anti-theft locking motor.

In the exemplary embodiment illustrated in FIGS. 8, 9, which is thus preferred, the control shaft 11 is also provided with an ejector contour 11*d* which, during a manual adjustment of the control shaft 11 from the "anti-theft locked" control position (FIG. 9*d*)) into the "unlocked" control position (FIG. 9*a*)), engages with the blocking element 17 and moves the blocking element 17 into the "locked" blocking position. This is advantageous for example in the event of failure of the drive motor 18 (anti-theft locking motor), when manual unlocking must be carried out, for example by means of a locking cylinder.

It is also pointed out that, in a further preferred development, the above-described bendable functional element 3 is coupled to one of the participating adjusting elements 1, 4, 5, preferably to the pawl 1, the outer actuating lever 4 or the inner actuating lever 5, in such a way that the bendable functional element 3 produces a preload of the respective adjusting element 1, 4, 5. This double utilization of the bendable functional element 3 has been discussed further above in conjunction with a pawl spring, an outer actuating lever spring or an inner actuating lever spring.

The realization of the "child-safety locked" functional state is likewise conceivable with the motor vehicle lock according to the proposal, as shown further below. For this purpose, in one preferred variant, a further bendable functional element 3 is provided which is likewise adjusted by the control drive 10.

FIGS. 10 to 13 show a further embodiment of a motor vehicle lock according to the proposal, which is fundamentally of similar design to the motor vehicle lock illustrated in FIGS. 4 and 5 and FIGS. 6 to 9. Said illustration also shows the abovementioned lock catch 1*a* which is associated with the pawl 1. Also provided here is a lock mechanism 2, with the lock mechanism 2 having an outer actuating lever 4 (not illustrated in FIG. 13) and an inner actuating lever 5. It is essential here, too, that a functional element 3 in the above sense is provided, which functional element is designed as a resiliently elastically bendable wire or strip and can thereby be bent in a resiliently elastic manner, as a bendable functional element, into different functional positions.

Provided in the exemplary embodiment shown in FIGS. 10 to 13, too, is a control drive 10 with a control shaft 11, on which control shaft 11 the associated bendable functional element 3 is supported. Furthermore, the control shaft 11 is likewise provided with an override contour 11*b* in the above sense. Finally, it is also provided here that the control shaft 11 can be moved not only into the "unlocked" and "locked" control positions but rather also into the "anti-theft locked" control position, in which the override contour 11*b* is, to an extent, deactivated. The "anti-theft locked" control position (FIG. 12) is also attained here in the blocked mode. In view of these consistencies, which form merely a selection, reference is made with regard to possible variants and advantages to the explanations relating to the exemplary embodiments illustrated in FIGS. 4 and 5, and correspondingly 6 to 9, in their entirety.

Figure 10:
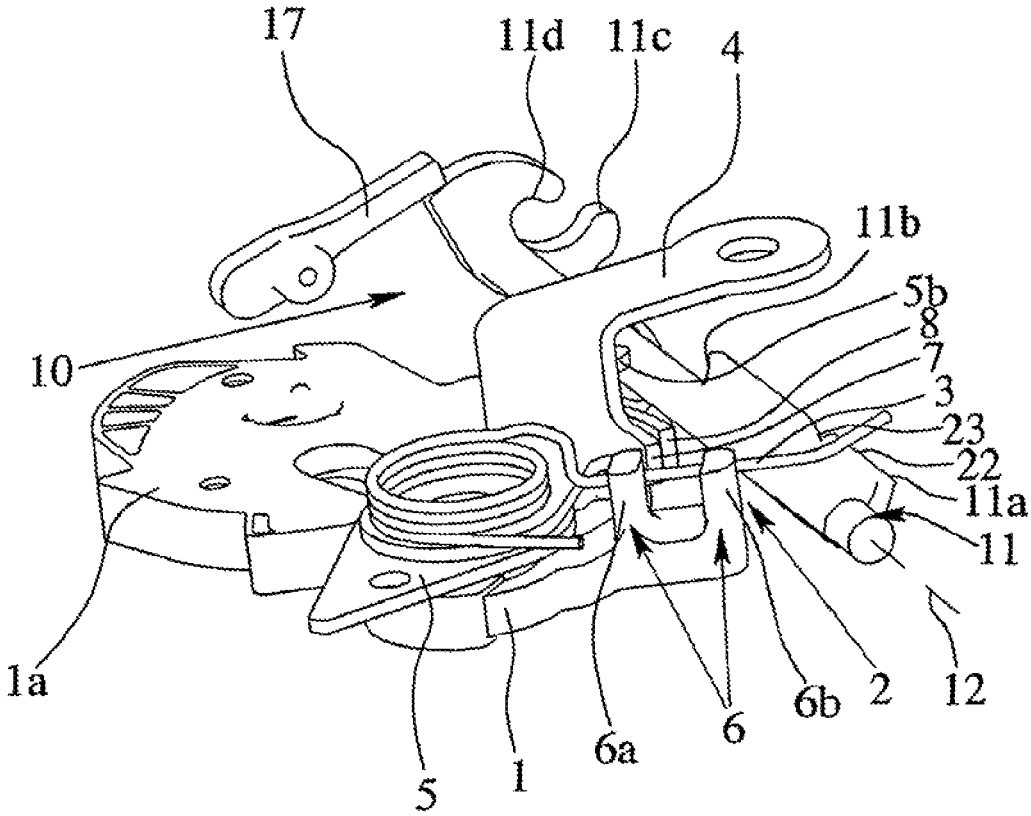
FIG. 10 shows a further motor vehicle lock according to the proposal with the components essential to the explanation of the invention, in a perspective illustration in the "unlocked" functional state.

FIG. 10 shows the "unlocked" functional state, in which the bendable functional element 3 is preferably not deflected. It can be seen from the illustration that the outer actuating lever 4 is coupled by means of the outer actuating driver contour 7 and the inner actuating lever 5 is coupled by means of the inner actuating driver contour 8, and in each case further by means of the bendable functional element 3 and the pawl driver contour 6, to the pawl 1.

Figure 11:
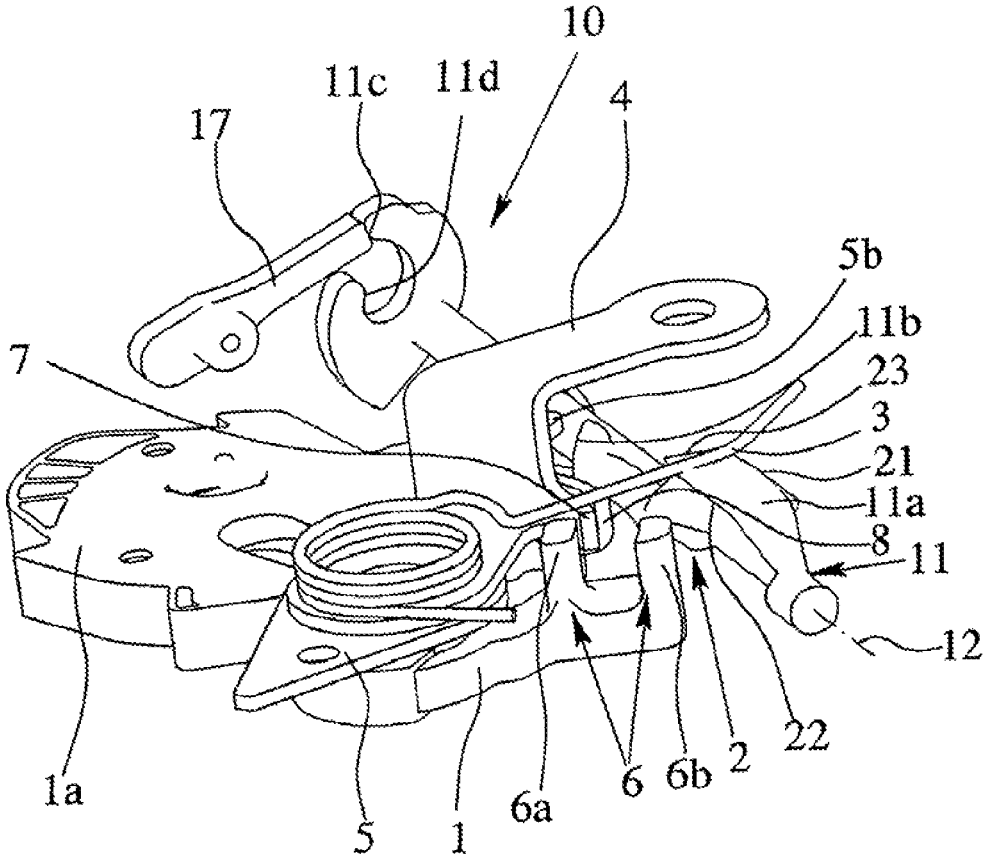
FIG. 11 shows the motor vehicle lock according to FIG. 10 in the "locked" functional state.
Figure 13:
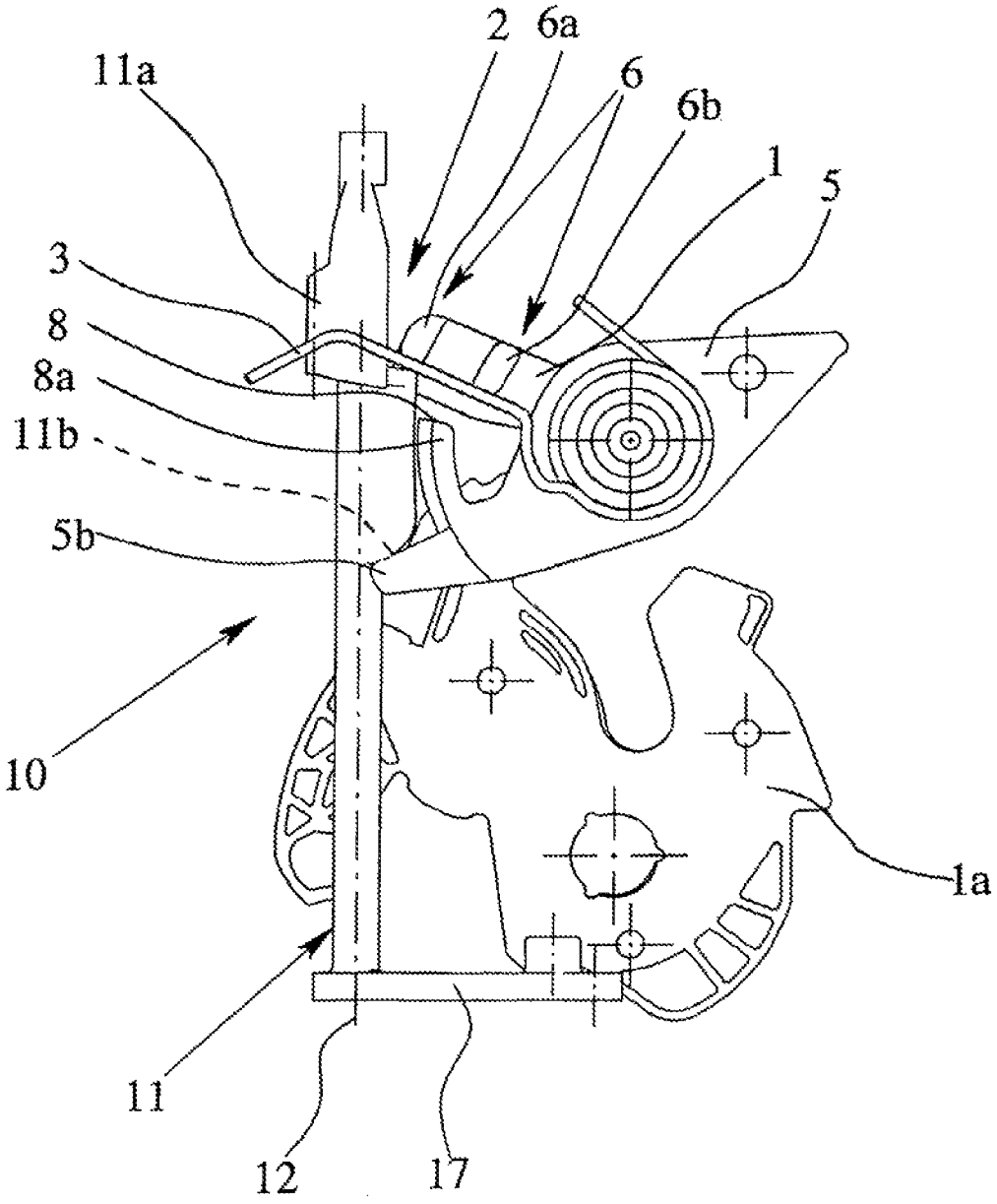
FIG. 13 shows the motor vehicle lock according to FIG. 10 in a plan view without the outer actuating lever, in the "locked" functional state during the actuation of the inner actuating lever.

FIGS. 11 and 13 show the "locked" functional state. Here, the bendable functional element 3 is deflected such that the bendable functional element 3 is disengaged from the outer actuating driver contour 7 and from the inner actuating driver contour 8. An actuation of the inner actuating lever 5 leads to an adjustment of the bendable functional element 3 into the "unlocked" functional position, as is explained in conjunction with the override contour 11*b*.

Figure 12:
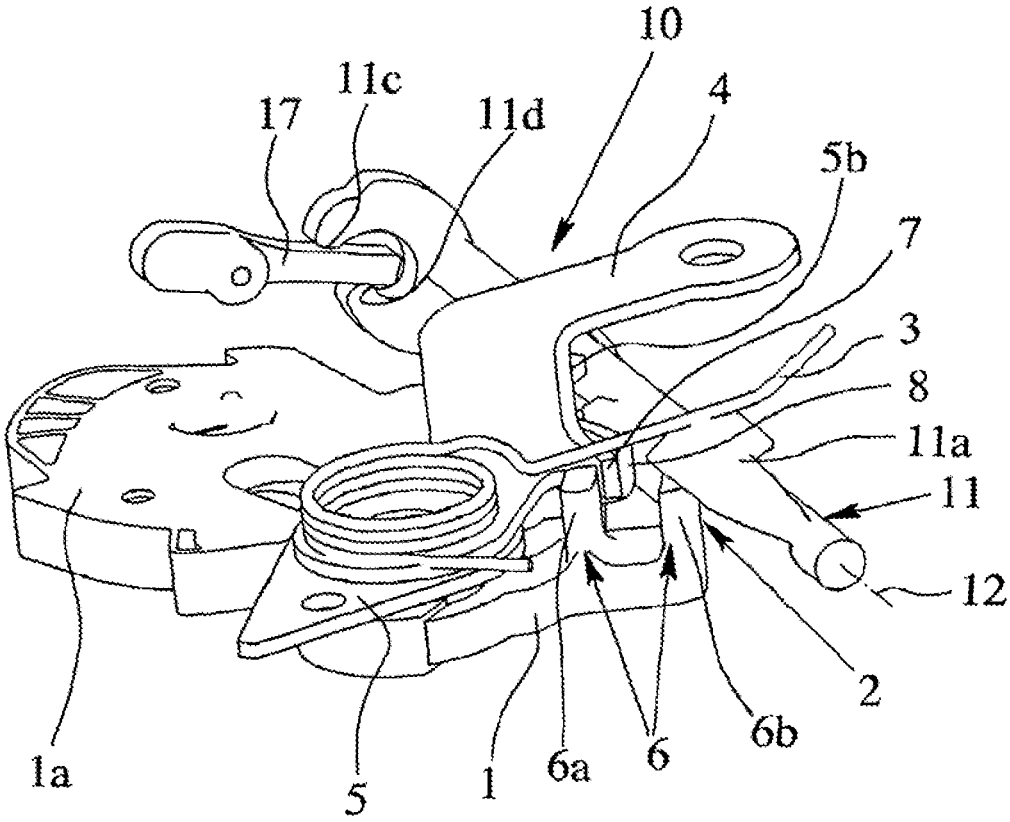
FIG. 12 shows the motor vehicle lock according to FIG. 10 in the "anti-theft locked" functional state.

FIG. 12 shows the "anti-theft locked" functional state, which differs from the "locked" functional state as explained in that the control-shaft-side override contour 11*b* is rotated out of the range of movement of the inner-actuating-lever-side override contour 5*b*.

One peculiarity can be seen, in the exemplary embodiment illustrated in FIGS. 10 to 13, in the realization of the outer actuating driver contour 7 and the inner actuating driver contour 8. Here, it is specifically provided that the outer actuating driver contour 7 and the inner actuating driver contour 8 are in each case designed in the form of a web and run along a circle segment in relation to the pivot axis of the outer actuating lever 4 and of the inner actuating lever 5 respectively. This can be seen particularly clearly in FIG. 13 for the inner actuating driver contour 8. Here, and preferably, it is also provided that the outer actuating driver contour 7 and the inner actuating driver contour 8 run directly adjacent to one another. This leads overall to a particularly compact arrangement. Here, it is also pointed out that such a design may be provided only for one of the two driver contours 7, 8.

In all the illustrated and thus preferable exemplary embodiments, it is provided that the pawl driver contour 6, the outer actuating driver contour 7 and the inner actuating driver contour 8 extend substantially parallel to the pivot axis of the pawl 1 and outer actuating lever 4 and inner actuating lever 5 respectively. This may also fundamentally be provided only for one of said driver contours 6, 7, 8. In particular, the height extents of the driver contours 6, 7, 8 may differ, as will be shown.

A further peculiarity can be seen, in the exemplary embodiment illustrated in FIGS. 10 to 13, with regard to the realization of the override contour 11*b* which, in the above sense, interacts with an inner-actuating-lever-side override contour 5*b*. Here, and preferably, the control-shaft-side override contour 11*b* is designed such that, in the "locked" functional state, in the event of an actuation of the inner actuating lever 5, the inner-actuating-lever-side override contour 5*b* travels substantially parallel to the control shaft axis 12 and moves the control shaft 11 into the "unlocked" control position. Here, the control-shaft-side override contour 11*b* is preferably designed as a run-on bevel which runs along the control shaft axis 12, in particular as a section of a worm contour which is aligned on the control shaft axis 12. The state in which the inner-actuating-lever-side override contour 5*b* enters into engagement with the control-shaft-side override contour 11*b* during the actuation of the inner actuating lever 5 is shown in the illustration of FIG. 13.

A further peculiarity of the exemplary embodiment illustrated in FIGS. 10 to 13 consists in the design of the cam 11*a* of the control shaft 11. Said cam 11*a* is specifically designed such that in each case stable states are produced for the control positions "unlocked", "locked" and "anti-theft locked" on account of the preload of the bendable functional element 3. The arrangement is designed such that, during an adjustment of the control shaft 11 between said control positions, an increased deflection of the bendable functional element 3 must be "overcome" in each case. This is realized in that the cam 11*a* is provided with corresponding edges 21, 22. As a result, the preload of the bendable functional element 3 together with the design of the cam 11*a* causes the control shaft 11 to be held in the respective control position.

The motor adjustment of the control shaft 11 also has a peculiarity in the exemplary embodiment illustrated in FIGS. 10 to 13. It is fundamentally the case here, too, that the control shaft 11 has a blocking contour 11*c* which can be engaged with a blocking element 17. Here, too, the control shaft 11 and the blocking element 17 can preferably be motor-adjusted. For this purpose, two drive motors (not illustrated) are provided, the drive shafts of which are more preferably aligned on the control shaft axis 12 or parallel to the control shaft axis 12.

The blocking element 17 blocks the control shaft 11 initially in the "locked" control position and, for this purpose, engages with the blocking contour 11*c*. To adjust the control shaft 11 into the "anti-theft locked" control position, the blocking element 17 is moved a short distance into a jaw-like molding of the blocking contour 11*c*. The control shaft 11 can thereupon be adjusted in the direction of the "anti-theft locked" control position until the blocking element 17 preferably becomes jammed in the jaw-like molding of the blocking contour 11*c* and blocks the further adjustment of the control shaft 11.

The above design of the blocking contour 11*c* of the control shaft 11 with a jaw-like molding thus saves an additional stop or the like, which is replaced here by the jamming of the blocking element 17.

The above jaw-like molding also has a further advantage. Specifically, said molding also provides an ejector contour 11*d* as explained in conjunction with the exemplary embodiment illustrated in FIGS. 8, 9, which ejector contour 11*d*, during a manual adjustment of the control shaft 11 from the "anti-theft locked" control position (FIG. 12) into the "unlocked" control position (FIG. 10), moves the blocking element 17 into the "locked" blocking position.

It is also the case here that, in the "anti-theft locked" control position, the override contour 11*b* is rotated out of the movement range of the inner-actuating-side override contour 5*b*. This corresponds substantially to the functional principle of the exemplary embodiments illustrated in FIGS. 4 to 9.

The design of the cam 11*a* of the control shaft 11 is finally advantageous in that it is assigned, at the side, a shoulder 23 which prevents the bendable functional element 3 from jumping laterally off the cam 11*a*.

It has already been pointed out that the motor vehicle lock according to the invention can easily be equipped with a child-safety locking function. For this purpose, FIGS. 14 and 15 show selected components of a control drive 10, in particular the control shaft 11 of a motor vehicle lock, which otherwise corresponds to the design shown in FIGS. 10 to 13.

Figure 14:
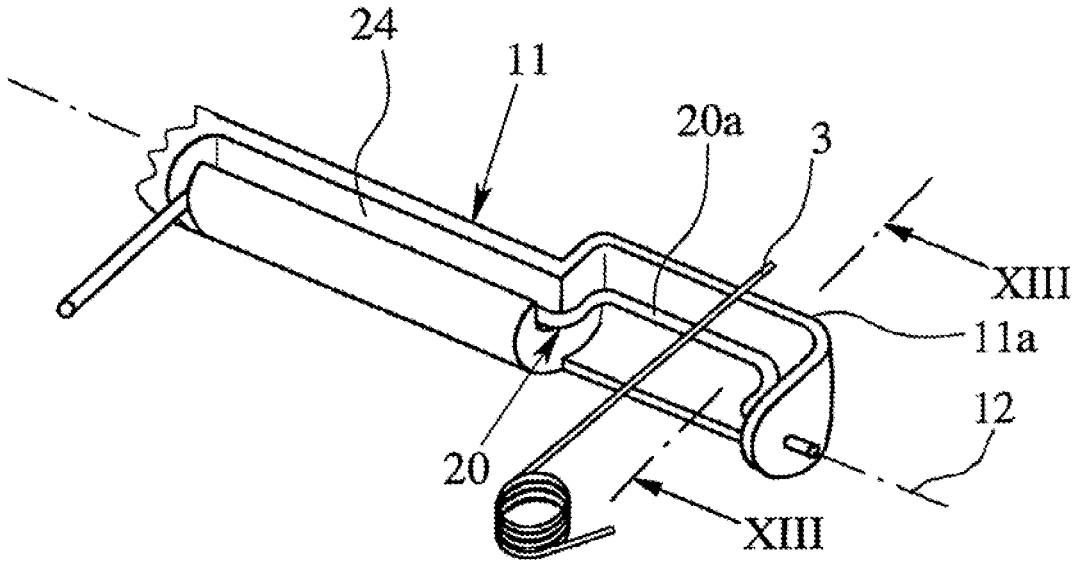
FIG. 14 shows a further motor vehicle lock according to the proposal, with selected components relating to the control drive, in a perspective illustration in the "unlocked" functional state.
Figure 15:
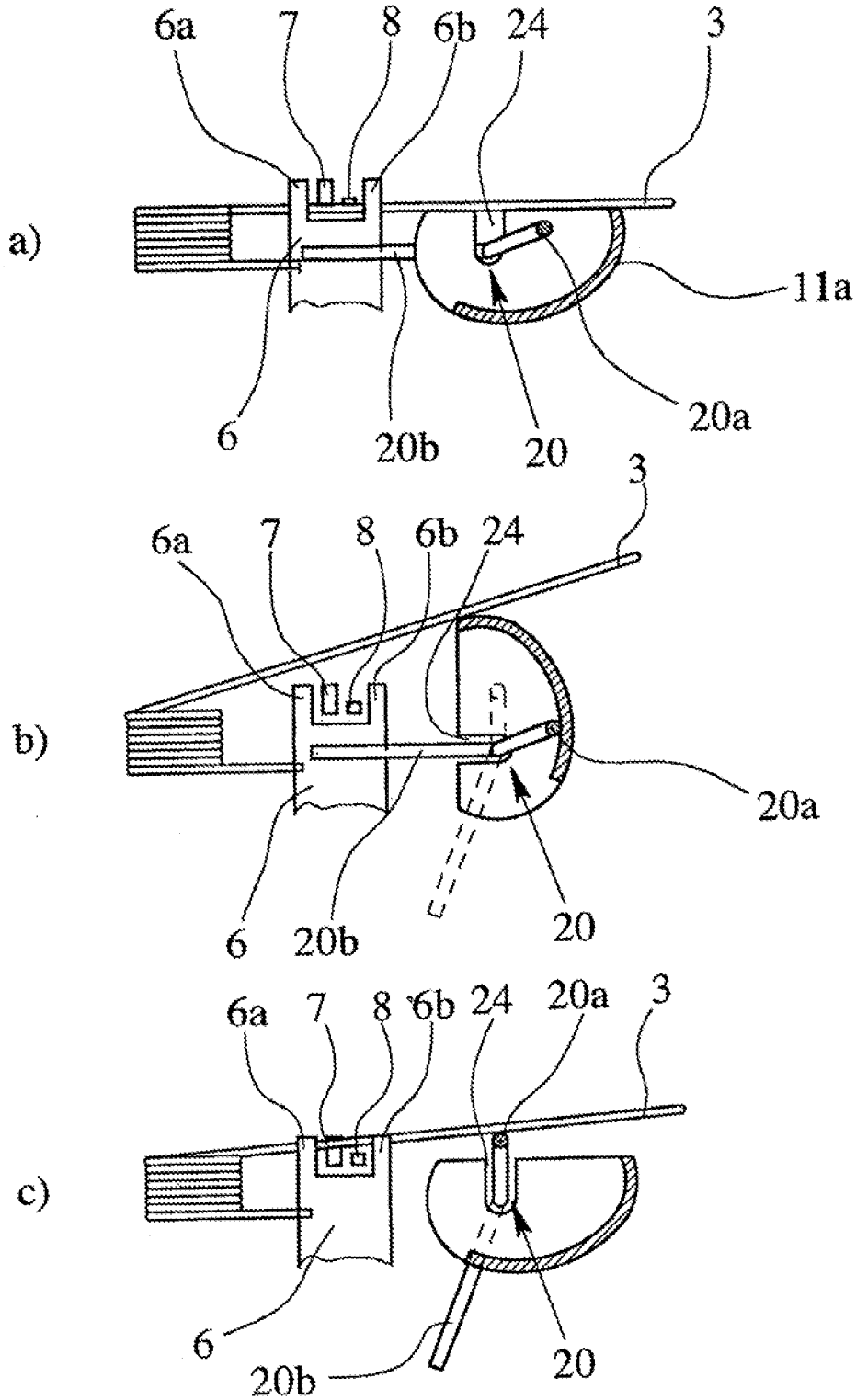
FIG. 15 shows the motor vehicle lock according to FIG. 14 in a sectional view along the section line XIII-XIII in the functional states a) "unlocked", b) "locked" ("locked and child-safety locked" illustrated by dashed lines) and c) "unlocked and child-safety locked"

The control shaft 11 illustrated in FIGS. 14 and 15 also operates in basically the same way as the control shaft 11 shown in FIGS. 10 to 13. Correspondingly, said control shaft 11 is equipped with a cam 11*a* (illustrated only schematically) for engaging with the bendable functional element 3.

An override contour 11*b* and a blocking contour 11*c* in the above sense are basically provided, but are not illustrated here.

In the exemplary embodiment illustrated in FIGS. 14 and 15, it is provided that the lock mechanism 2 can, in the above sense, be moved in parallel into the "child-safety locked" functional state, and that, in this way, the "unlocked" functional position automatically moves into the "unlocked—child-safety locked" functional position. This means that an adjustment of the control shaft 11 into the "unlocked" control position causes an adjustment of the bendable functional element 3 not into the "unlocked" functional position but rather into the "unlocked—child-safety locked" functional position.

In the "unlocked—child-safety locked" functional position, the inner actuating lever 5 is decoupled from the pawl 1 and couples the outer actuating lever 4 to the pawl 1. In the lock mechanism 2, therefore, measures are provided to ensure that, in the "child-safety locked" state, an unlocking process automatically causes the bendable functional element 3 to be moved into the "unlocked—child-safety locked" functional position. The "unlocked—child-safety locked" functional position is preferably situated between the "unlocked" functional position and the "locked" functional position.

The "unlocked—child-safety locked" functional position of the bendable functional element 3 is schematically illustrated in FIG. 15 *c*). Here, it can be seen that the outer actuating driver contour 7 and the inner actuating driver contour 8 are designed such that, in said functional position, the bendable functional element 3 is disengaged from the inner actuating driver contour 8 and the inner actuating lever 5 is decoupled from the pawl 1, and that the outer actuating lever 4 is coupled by means of the outer actuating driver contour 7, the bendable functional element 3 and the pawl driver contour 6 to the pawl 1. Said selective coupling of the two above driver contours 7, 8 is realized in that, as viewed in the deflecting direction of the bendable functional element 3, the outer actuating driver contour 7 has a greater height extent than the inner actuating driver contour 8. This can be seen from the illustration in FIG. 15. The driver contours 6, 7, 8 are not illustrated in FIG. 14.

FIGS. 14 and 15 show a particularly compact realization of the "child-safety locked" functional state. For this purpose, a further functional element is provided, specifically an independently adjustable child-safety locking element 20 which can be adjusted between a "child-safety locked" position (FIG. 15*c*)) and a "child-safety unlocked" position (FIG. 15 *a*), *b*)). Said adjustment of the child-safety locking element 20 corresponds to the engagement of the "child-safety locked" and "child-safety unlocked" functional states.

In the "child-safety locked" functional state, the child-safety locking element 20, in the event of an adjustment of the control shaft 11 into the "unlocked" control position, holds the bendable functional element 3 in the "unlocked—child-safety locked" functional position upstream of the "unlocked" functional position. This means that, in the "child-safety locked" functional state, the control shaft 11 can be moved into all possible control positions, with the setting of the "unlocked" control position causing the bendable functional element 3 to be held in the upstream "unlocked—child-safety locked" functional position.

During the adjustment of the control shaft 11 into the "locked" control position, if the child-safety locking arrangement is engaged, the bendable functional element 3 is adjusted, in an unchanged manner, into the "locked" functional position. The actuation of the inner actuating lever 5 also causes an unlocking process by means of the override contour 11*b*. Here, however, the bendable functional element 3 falls back only into the upstream "unlocked—child-safety locked" functional position, such that the pawl 1 cannot be raised by means of the inner actuating lever 5.

Numerous advantageous variants are conceivable for the structural realization of the child-safety locking element 20. In one particularly preferred development, the child-safety locking element 20 is designed as a child-safety locking shaft, with the child-safety locking shaft 20 more preferably being aligned on the control shaft axis 12. This is illustrated in FIGS. 14 and 15. This leads to a particularly compact arrangement if the child-safety locking shaft 20 is at least partially integrated into the control shaft 11. Here, and preferably, the child-safety locking shaft 20 is integrated completely into the control shaft 11, with the child-safety locking shaft 20 being arranged in a cutout 24 in the control shaft 11.

For the engagement of the child-safety locking shaft 20 with the bendable functional element 3, it may be advantageous for the child-safety locking shaft 20 to be designed in the form of a camshaft, specifically in such a way that the associated bendable functional element 3 is supported on the camshaft. In the exemplary embodiment illustrated in FIGS. 14 and 15, which is thus preferred, the child-safety locking shaft 20 is however designed in the form of a crankshaft, and the associated bendable functional element 3 is supported on the crankshaft 20. Here, the crankshaft 20 has an engagement section 20*a* which can be correspondingly engaged with the bendable functional element 3. The child-safety locking shaft 20 is formed, in an advantageous manner in terms of production, in one piece, in particular as a bent wire or the like.

The child-safety locking element 20 can, as explained, be moved into the "child-safety locked" position and "child-safety unlocked" position. For this purpose, an adjusting section 20*b* is associated with the child-safety locking element 20, by means of which adjusting section 20*b* the child-safety locking element 20 can be adjusted. For example, said adjusting section 20*b* is coupled to a child-safety locking switch accessible from the end side of a side door, or to a child-safety locking drive.

From a juxtaposition of the illustrations in FIG. 15, it can also be seen that the child-safety locking element 20, when situated in the "child-safety unlocked" position, does not influence the adjustment of the bendable functional element 3. The bendable functional element 3 can be moved into the "unlocked" functional position (FIG. 15*a*)), into the "locked" functional position (FIG. 15*b*)) and into the "anti-theft locked" functional position (not illustrated). It is a different situation when the "child-safety locked" functional state is set, as shown in FIG. 15*c*). Here, the control shaft 11 is situated in the "unlocked" control position. The bendable functional element 3 however does not attain the "unlocked" functional position, but rather is automatically held in the "unlocked—child-safety locked" position by the child-safety locking element 20. The resulting functional behavior has been explained further above.

In all the illustrated exemplary embodiments, the control shaft 11 is preferably produced from a plastic material which has the highest possible hardness. At the same time, the materials should be selected such that the least possible friction is generated between the bendable functional element 3 and the control shaft 11.

If the pawl driver contour 6 has two or more bearing blocks 6*a*, 6*b* as discussed above, it is preferable for the height extent of the two bearing blocks 6*a*, 6*b* to differ as viewed in the direction of the deflection of the bendable functional element 3. The upper sides of the bearing blocks 6*a*, 6*b* preferably lie on a straight line which is aligned substantially parallel to the fully deflected bendable functional element 3.

A further optimization of the motor vehicle lock according to the proposal consists in that the control shaft 11 has a further contour which may be associated with a lock bolt or the like. Such an additional contour may fundamentally be realized with little expenditure and with a high level of compactness.

One preferred development which may be used within the context of emergency actuation consists in that the bendable functional element 3 is situated at all times in the movement range of an emergency actuating lever, specifically independently of the functional position of the bendable functional element 3.

With the above explanations, it has been possible to show that the design of a functional element 3 as a bendable functional element can be realized using simple structural means. Additional mounting of the bendable functional element 3 is not required. Correspondingly, there are barely any friction losses. Furthermore, with the use of the bendable functional element 3, particular advantages emerge with regard to possible icing of the vehicle lock, which often leads to blockage of conventionally mounted levers. Such blockage is virtually ruled out with the bendable functional element 3 according to the proposal.

Furthermore, with the design of a functional element 3 as a bendable functional element, the present functional state of the lock mechanism 2 can be determined in a simple manner from a control engineering aspect. For this purpose, a detection device 25 is preferably provided, with the arrangement preferably being designed such that a deflection of the bendable functional element 3 can be determined by means of the detection device 25. For this purpose, the detection device 25 preferably has an electric switch 26. In a particularly preferred refinement, the switch 26 is not an additional switch. In fact, the bendable functional element 3 is preferably formed as an integral part of the switch 26. This means that the bendable functional element 3 not only at least partially coincides spatially with the switch 26, but rather the bendable functional element 3 provides at least a part of the function of the electric switch 26.

A simple realization is possible if the electric switch 26 has a movable switching element which, during a switching process, is engaged with or disengaged from at least one associated switching contact 27, wherein here, the bendable functional element 3 provides the switching element of the switch 26. The double utilization of the bendable functional element 3 is particularly pronounced here. Firstly, the bendable functional element 3 performs a function within the context of the mechanical functional structure of the motor vehicle lock (coupling function). Secondly, the bendable functional element 3 provides the switching element of the electrical switch 26 of the detection device 25.

Figure 16:
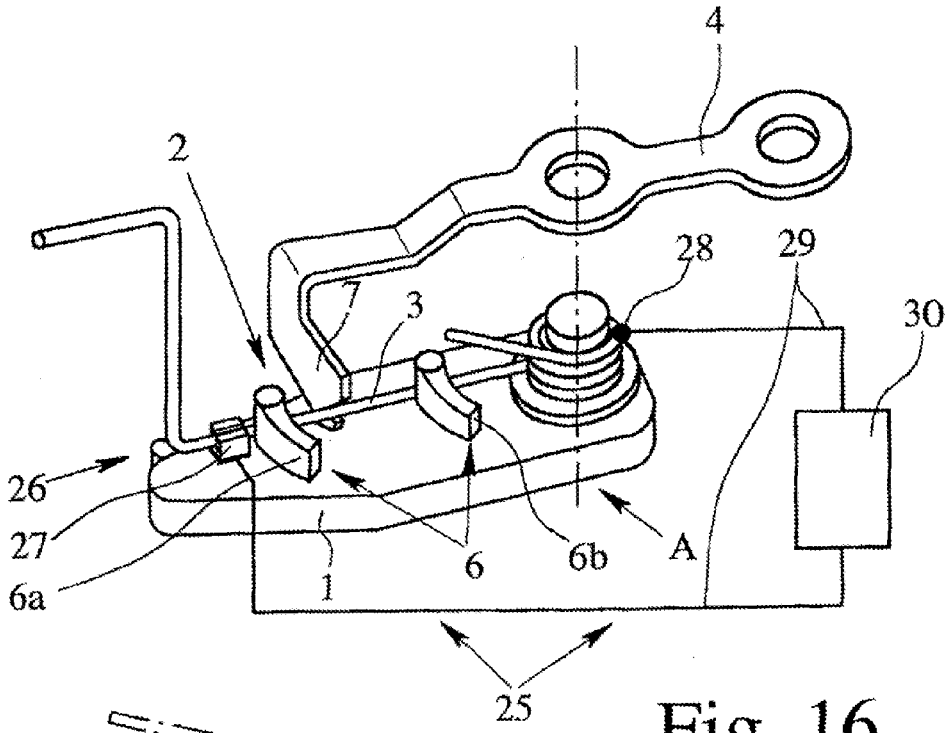
FIG. 16 shows a further motor vehicle lock according to the proposal in a view as per FIG. 1.
Figure 17:
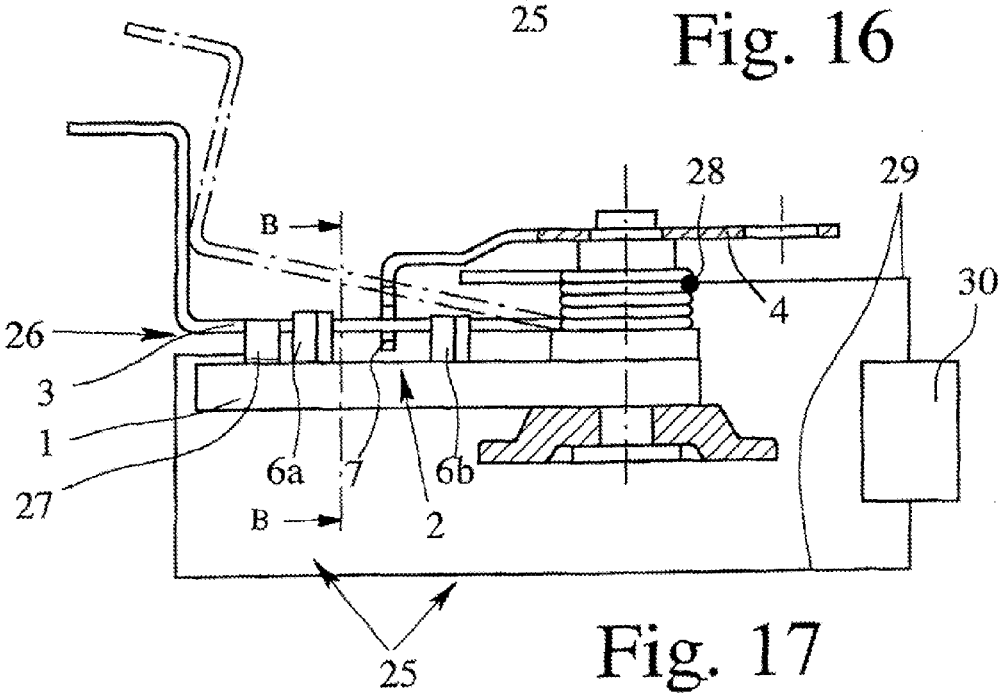
FIG. 17 shows the motor vehicle lock according to FIG. 16 in the view A.

The basic design of the detection device 25 according to the proposal is shown in FIGS. 16 and 17. The arrangement shown therein corresponds, in terms of mechanical function, to the exemplary embodiment illustrated in FIGS. 1 to 3. In this respect, reference is made to the statements given above.

In the non-deflected "unlocked" functional state illustrated in FIG. 16, the bendable functional element 3, which provides the movable switching element of the switch 26, is engaged with the switching contact 27. Furthermore, the bendable functional element 3 is also electrically connected to the detection device 25 by means of a stationary contact 28. Both the switching contact 27 and also the stationary contact 28 are connected here, and preferably, by means of a conductor arrangement 29 to an optional evaluating unit 30.

It is also possible to dispense with an evaluating unit 30. Here, the electric switch 26 of the detection device 25 is preferably connected directly into the load circuit of an associated electrical drive, of an associated electrical lamp or the like. The electric switch 26 then switches correspondingly to the load current. It may however also be advantageous for the electric switch 26 to be connected into the load circuit of a corresponding consumer not directly but rather indirectly, specifically via a relay or an amplifier stage.

It is clear from the illustration in FIG. 16 that a deflection of the bendable functional element 3, which causes an unlocking of the motor vehicle lock, eliminates the contact of the bendable functional element 3 with the switching contact 27. It is thus possible to determine the deflection of the bendable functional element 3, and therefore the present functional state of the lock mechanism 2, in a simple manner.

In a development which is particularly advantageous from a production aspect, a lead frame is provided which is preferably integrated into the lock housing. Such a lead frame is regularly used in motor vehicle locks for the contacting of drives and sensors. Here, and preferably, the at least one switching contact 27 is provided by the lead frame, more preferably by lead frame tongues which project out of the lock housing. This has the particular advantage that a high degree of mechanical stability of the at least one switching contact 27 is ensured.

Figure 18:
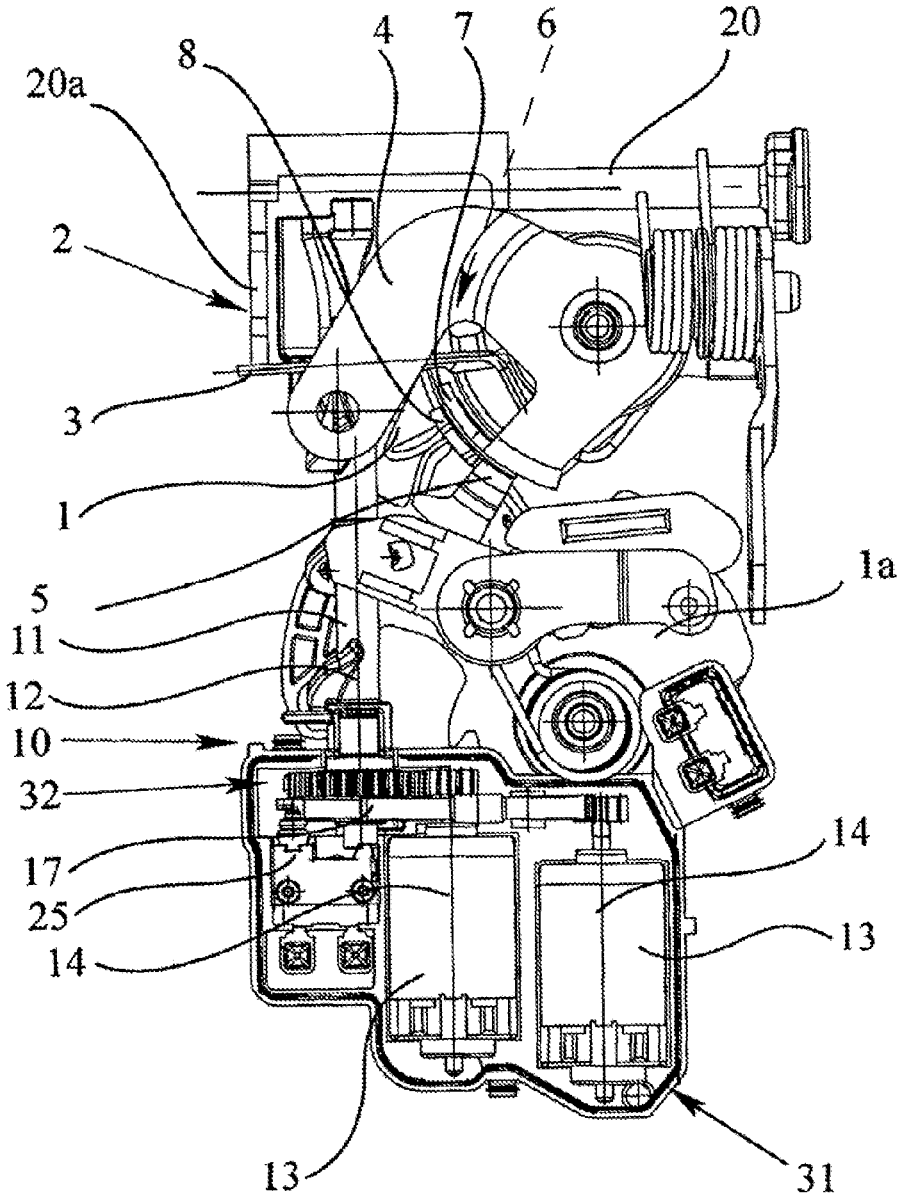
FIG. 18 shows a further motor vehicle lock according to the proposal in a view as per FIG. 13 without a cover of the electronic component carrier.
Figure 19:
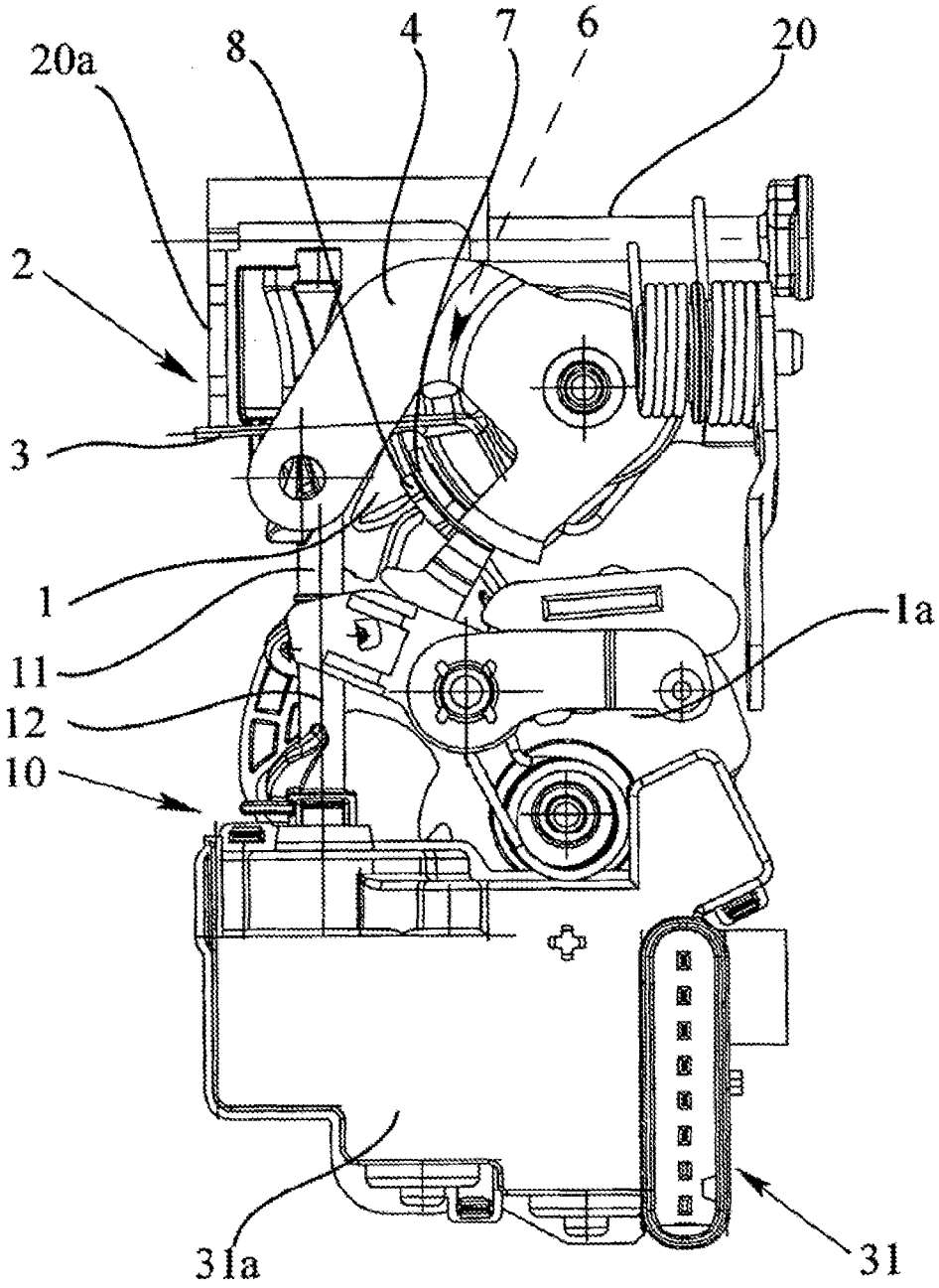
FIG. 19 shows the motor vehicle lock according to FIG. 18 with the cover of the electronic component carrier fitted.
Figure 20:
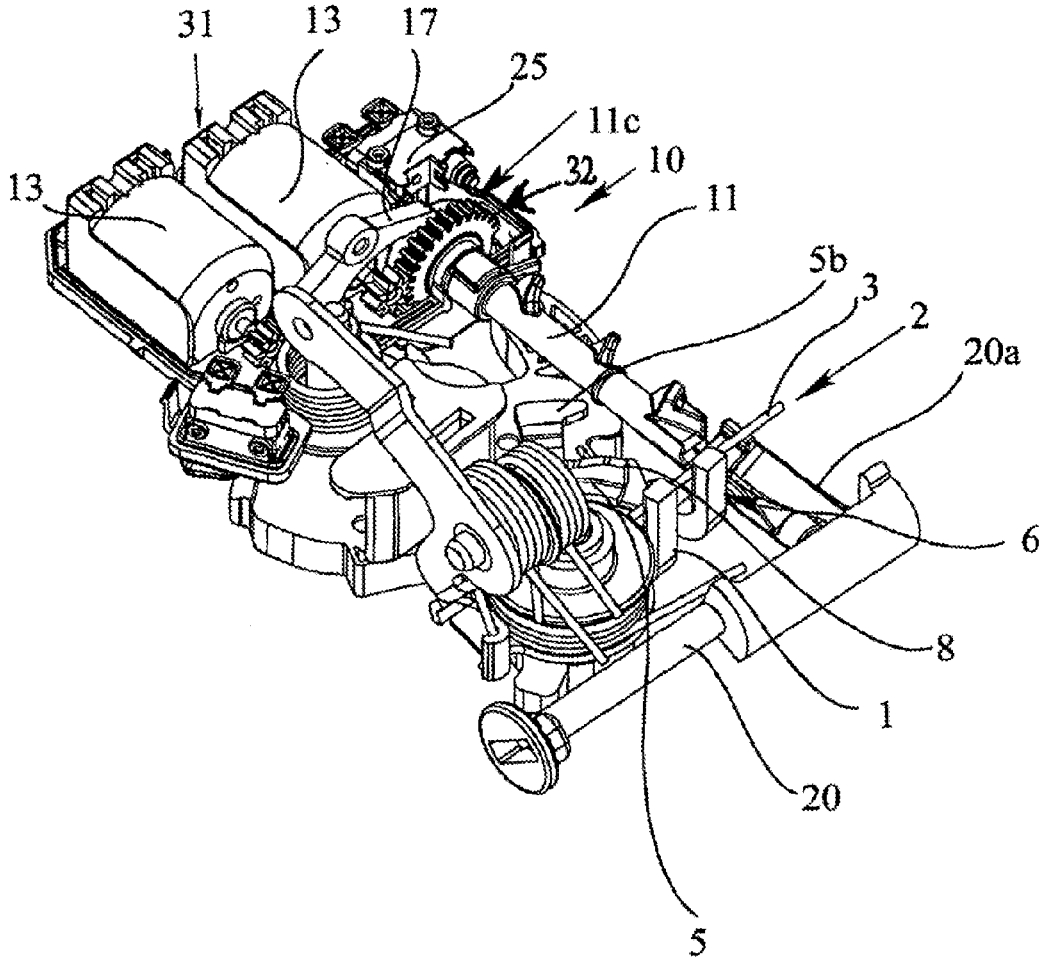
FIG. 20 shows the motor vehicle lock according to FIG. 18 without the cover of the electronic component carrier, in a perspective detail view.

FIGS. 18 to 20 illustrate a further motor vehicle lock according to the proposal, which corresponds in terms of basic design to the motor vehicle lock illustrated in FIGS. 10 to 13, such that in this respect, reference may be made to the statements given above. Identical reference numerals have been correspondingly used for functionally equivalent parts.

In structural terms, an interesting aspect of the motor vehicle lock illustrated in FIGS. 18 to 20 is the fact that an electronic component carrier 31 is provided for holding the motor components of the control drive 10, which electronic component carrier 31 is otherwise encapsulated with respect to the motor vehicle lock with the exception of apertures required for mechanical drive connections, in this case the apertures required for the drive of the control shaft 11. Depending on the design of the lock housing, the electronic component carrier 31 is arranged either within the lock housing (housing in housing) or directly outside the lock housing. The electronic component carrier 31 is assigned a cover 31*a* which is illustrated only in FIG. 19.

Here, and preferably, the motor components of the control drive 10 are two drive motors 13 of the control drive 10, as is also illustrated in FIG. 8. Here, one drive motor 13 is assigned to the blocking contour 11*c* or the control shaft 11, and a further drive motor 13 is assigned to the blocking element 17.

Here, and preferably, it is also the case that both the blocking contour 11*c* and also the blocking element 17 are arranged within the electronic component carrier 31. This has the advantage that further apertures in the electronic component carrier 31 for the two drive shafts 14 of the drive motors 13 are not required.

A further interesting aspect of the exemplary embodiment illustrated in FIGS. 18 to 20 is the fact that the drive motor 13 assigned to the control shaft 11 is engaged with the control shaft 11 via a permanent coupling 32. The coupling 32 comprises a coupling body which is fixedly connected to the control shaft 11. The coupling body is provided on the circumference with a toothed segment which meshes with a pinion of the associated drive motor 13. The coupling 32 is also provided with a switching contour (illustrated only in FIG. 18) with which a detection device 25 in the above sense is associated. Here, and preferably, the detection device 25 is designed as a switch, preferably as a multi-stage, in particular three-stage, switch.

Furthermore, the coupling 32 preferably has a spring detent which, depending on the functional position of the control shaft 11, comes into latching engagement with a fixed part, in particular with the cover 31*a* of the electronic component carrier 31.

As in the exemplary embodiment illustrated in FIGS. 10 to 13, the blocking contour 11*c* is provided with a jaw-like molding which, in the illustration according to FIG. 20, is situated on the rear side of the coupling 32.

In production terms, an advantage of the exemplary embodiment illustrated in FIGS. 18 to 20 is the fact that the components of blocking contour 11*c* with jaw-like molding, coupling body, switching contour and spring detent are combined in a single-piece plastic part, in particular in one injection-molded part.

In the exemplary embodiment illustrated in FIGS. 18 to 20, the blocking element 17 is likewise identical in terms of function to the blocking element 17 illustrated in FIGS. 10 to 13. One peculiarity here is that the blocking element 17 illustrated in FIGS. 18 to 20 is designed as a two-armed lever.

At this juncture, it is pointed out that, in the two-motor solutions illustrated in FIGS. 10 to 13 and 18 to 20, a particularly advantageous sequence of current supply to the motors is conceivable. Here, it is provided that the two drive motors 13 are temporarily supplied with current in such a way as to run counter to one another in order to eliminate play between the blocking contour 11*c* and the blocking element 17. This is particularly advantageous during an adjustment from the "anti-theft locked" functional state as per FIG. 12 into the "locked" functional state as per FIG. 11.

The exemplary embodiment illustrated in FIGS. 18 to 20 is also provided with a child-safety locking function which is identical in terms of function to the child-safety locking arrangement illustrated in FIGS. 14 and 15. Correspondingly, a child-safety locking shaft 20 with an engagement section 20*a* is provided here too. In the exemplary embodiment illustrated in FIGS. 18 to 20, which is thus preferred, the child-safety locking shaft 20 is however aligned substantially perpendicular to the control shaft axis 12.

In a particularly preferred development, the child-safety locking shaft 20, in particular the child-safety locking shaft 20 running transversely in the above sense, is accommodated in a cover (not illustrated) of the motor vehicle lock. With the motor vehicle lock according to the proposal, therefore, it is possible in a simple manner to realize a variant with child-safety locking and a variant without child-safety locking, specifically by virtue of a cover with or without a child-safety locking shaft 20 being mounted.

In all the above exemplary embodiments, the defined positioning of the control shaft 11 is of particular significance. This can be achieved, as described above, by means of a spring detent 32*c*. It is however also conceivable in this connection to provide a special design of the bendable functional element 3. Here, the bendable functional element 3 is not of substantially straight design but rather has latching moldings which can be engaged with corresponding counterpart moldings on the control shaft 11. It is thereby possible for the bendable functional element 3 to be deflected by means of an adjustment of the control shaft 11 until a latching molding in the bendable functional element 3 comes into latching engagement with a corresponding counterpart molding on the control shaft 11. This type of latching can be realized without additional parts, and therefore in a cost-effective manner.

Finally, reference may be made to a preferred development of the bendable functional element 3 in which the bendable functional element 3 is specially shaped in one section such that its resiliently elastic flexibility is increased in said section. For example, the bendable functional element 3 may in particular be helically coiled in said section. The bendable functional element 3 may then be of otherwise rigid design. Here, a multi-part design of the bendable functional element 3 is also conceivable.

In a further teaching which is likewise worthy of protection in itself, the control drive 10 itself is claimed. All the variants of the control drive 10 discussed above apply in their entirety to said further teaching.

In addition to the easy realizability as discussed above, a particular advantage of the control drive 10 according to the proposal is that it is possible in a simple manner to query the respective control position by virtue of a corresponding sensor being assigned to the control shaft 11. The sensor may be designed as a simple microswitch, if appropriate as a multi-stage microswitch.

Where reference is made in the above description and in the claims to the inner actuating lever and outer actuating lever, these should also be understood to include all intermediate levers arranged in one of the force-transmission paths in question.

The invention claimed is:

1. A motor vehicle lock having locking elements and having a lock mechanism, the locking elements comprising a lock catch and a pawl, wherein the lock catch interacts with the pawl and wherein the lock mechanism is moveable into different functional states selected from "unlocked," "locked," "anti-theft locked" and "child-safety locked," wherein the lock mechanism includes at least one functional element which can be adjusted into functional positions corresponding to the different functional states, wherein the motor vehicle lock comprises at least two pivotable adjusting elements and wherein at least one functional element is designed as a resiliently elastically bendable wire or strip, and can thereby be bent in a resiliently elastic manner, as a bendable functional element, into different functional positions and the bendable functional element provides a switchable coupling between at least two of the pivotable adjusting elements of the motor vehicle lock, and in a first functional position, the bendable functional element is or can be engaged with the pivotable adjusting elements and the bendable functional element couples the pivotable adjusting elements, and in a second functional position, the bendable functional element is disengaged from at least one of the pivotable adjusting elements and decouples the pivotable adjusting elements.

2. The motor vehicle lock as claimed in claim 1, wherein the bendable functional element is bendable substantially about a geometric bending axis which is aligned perpendicular to the longitudinal extent of at least a part of the bendable functional element.

3. The motor vehicle lock as claimed in claim 1, wherein the bendable functional element is of straight design at least in sections, and wherein the bendable functional element is of resiliently elastically flexible design only in sections, and is otherwise of rigid design.

4. The motor vehicle lock as claimed in claim 1 wherein the bendable functional element is designed in the form of a flexible beam.

5. The motor vehicle lock as claimed in claim 1, wherein the bendable functional element serves as an actuating element for a switchable coupling element between two adjusting elements of the motor vehicle lock, or wherein the bendable functional element itself provides a switchable coupling between two adjusting elements of the motor vehicle lock.

6. The motor vehicle lock as claimed in claim 1, wherein the force which can be transmitted via the bendable functional element acts perpendicular to the extent of the bendable functional element.

7. The motor vehicle lock as claimed in claim 1, wherein the bendable functional element, in one functional position, exerts a blocking action on an adjusting element of the lock mechanism.

8. The motor vehicle lock as claimed in claim 1, wherein the lock mechanism has a pivotable outer actuating lever and a pivotable inner actuating lever, and the lock mechanism can, by means of an adjustment of the at least one bendable functional element into different functional positions, be moved into the corresponding functional states selected from "unlocked", "locked", "anti-theft locked", "child-safety locked", and combinations thereof.

9. The motor vehicle lock as claimed in claim 8, wherein the bendable functional element is aligned substantially radially in relation to one of the pivot axes of the outer actuating lever, of the inner actuating lever which may be provided and of the pawl, with the outer actuating lever, the inner actuating lever which may be provided and the pawl preferably being pivotable about the same pivot axis.

10. The motor vehicle lock as claimed in claim 8, wherein the pawl or a lever which is coupled to the pawl has a pawl driver contour, wherein the outer actuating lever or a lever which is coupled to the outer actuating lever has an outer actuating driver contour, and, when the bendable functional element is in the "unlocked" functional position, the outer actuating lever is coupled by means of the outer actuating driver contour, the bendable functional element and the pawl driver contour to the pawl, and wherein, in the "locked" functional state, the bendable functional element is disengaged from the pawl driver contour, from the outer actuating driver contour, or a combination thereof and the outer actuating lever is decoupled from the pawl.

11. The motor vehicle lock as claimed in claim 10, wherein the inner actuating lever or a lever which is coupled to the inner actuating lever has an inner actuating driver contour, wherein, when the bendable functional element is in the "unlocked" functional position, the inner actuating lever is coupled by means of the inner actuating driver contour, the bendable functional element and the pawl driver contour to the pawl, and wherein, in the "locked" functional state, the bendable functional element is disengaged from the pawl driver contour, from the inner actuating driver contour, or a combination thereof and the inner actuating lever is decoupled from the pawl.

12. The motor vehicle lock as claimed in claim 8, wherein when the lock mechanism is in the "locked" functional state, an actuation of the inner actuating lever causes the lock mechanism to be moved into the "unlocked" functional state, wherein, with regard to the actuation of the inner actuating lever, an initial free travel is provided and the lock mechanism is moved into the "unlocked" functional state when the free travel is run through.

13. The motor vehicle lock as claimed in claim 1, wherein a control drive in the form of a motor is provided, with which control drive the at least one bendable functional element is associated, and wherein, by means of the control drive, the associated bendable functional element can be adjusted into at least one functional position, and wherein the control drive has a control shaft on which the associated bendable functional element is supported, such that the bendable functional element can be deflected by means of an adjustment of the control shaft, and wherein the control shaft can be moved into the control positions "unlocked" and "locked" and the associated bendable functional element then moves into or enables the corresponding functional positions.

14. The motor vehicle lock as claimed in claim 13, wherein the control shaft is designed in the form of a camshaft and the associated bendable functional element is supported on the camshaft and can be correspondingly deflected by means of an adjustment of the camshaft, or, the control shaft is designed in the form of a crankshaft and in that the associated bendable functional element is supported on the crankshaft, wherein the control shaft is designed in the form of a bent wire, and wherein the control shaft is simultaneously the motor shaft of the drive motor.

15. The motor vehicle lock as claimed in claim 13, wherein an adjustment of the control shaft into the "locked" and "anti-theft locked" control positions takes place in each case in the blocked mode, wherein the control shaft has for this purpose a blocking contour which can be engaged with a blocking element, wherein the blocking element is designed such that it can be adjusted, and moved into the "locked" and "anti-theft locked" blocking positions by means of a motor, and wherein the control shaft has an ejector contour which, during a manual adjustment of the control shaft from the "anti-theft locked" control position into the "unlocked" control position, engages with the blocking element and moves the blocking element into the "locked" blocking position.

16. The motor vehicle lock as claimed in claim 1, wherein the bendable functional element is coupled to the pawl, the outer actuating lever or the inner actuating lever, in such a way that the bendable functional element produces a preload of the adjusting element.

17. The motor vehicle lock as claimed in claim 8, wherein the lock mechanism can, in parallel, be moved into the "child-safety locked" functional position and in that, in this way, the "unlocked" functional position automatically moves into the "unlocked—child-safety locked" functional position, in which the inner actuating lever is decoupled from the pawl and the outer actuating lever is coupled to the pawl, and wherein the "unlocked—child-safety locked" functional position is situated between the "unlocked" functional position and the "locked" functional position.

18. The motor vehicle lock as claimed in claim 17, wherein to realize the "child-safety locked" functional state, the control drive has an independently adjustable child-safety locking element which, in the "child-safety locked" functional state, in the event of an adjustment of the control shaft into the "unlocked" control position, holds the bendable functional element in the "unlocked—child-safety locked" position upstream of the "unlocked" functional position, wherein the child-safety locking element is designed as a child-safety locking shaft, and the child-safety locking shaft is aligned on the control shaft, wherein the child-safety locking shaft is at least partially or completely integrated into the control shaft, or is arranged at least partially or completely in a cutout in the control shaft.

19. The motor vehicle lock as claimed in claim 1, wherein a detection device is provided for determining the present functional state of the lock mechanism, and the arrangement is designed such that a deflection of the bendable functional element can be determined by means of the detection device.

20. The motor vehicle lock as claimed in claim 1, wherein an electronic component carrier is provided for holding the motor components of the control drive, which electronic component carrier is otherwise encapsulated with respect to the motor vehicle lock with the exception of apertures required for mechanical drive connections, wherein the blocking element and the blocking contour are arranged within the electronic component carrier.

* * * * *